US006390292B2

(12) United States Patent
Hawthorne

(10) Patent No.: US 6,390,292 B2
(45) Date of Patent: May 21, 2002

(54) CONTAINER FOR SEPARATELY STORING FLOWABLE MATERIALS BUT ALLOWING MIXING OF MATERIALS WHEN REQUIRED

(75) Inventor: Donn Bede Hawthorne, Victoria (AU)

(73) Assignee: Carlton and United Breweries Limited, Southbank (AU)

( * ) Notice: Subject to any disclaimer, the term of this patent is extended or adjusted under 35 U.S.C. 154(b) by 0 days.

(21) Appl. No.: 09/745,679

(22) Filed: Dec. 22, 2000

Related U.S. Application Data

(63) Continuation of application No. 09/445,651, filed as application No. PCT/AU98/00429 on Jun. 9, 1998, now abandoned.

(30) Foreign Application Priority Data

| | | |
|---|---|---|
| Jun. 11, 1997 | (AU) | PO7259 |
| Aug. 14, 1997 | (AU) | PO8538 |
| Dec. 5, 1997 | (AU) | PP0772 |

(51) Int. Cl.[7] ..... B65D 25/08

(52) U.S. Cl. ..... 206/219; 206/568; 206/221; 215/DIG. 8; 446/112; 446/115

(58) Field of Search ..... 206/219–222, 206/568; 215/6, 10, DIG. 8; 426/115, 112, 120

(56) References Cited

U.S. PATENT DOCUMENTS

| | | | | |
|---|---|---|---|---|
| 4,618,444 | A | 10/1986 | Hudson et al. | 206/219 |
| 5,009,901 | A | 4/1991 | Byrne | 206/219 |
| 5,196,216 | A | 3/1993 | Lynch et al | 206/221 |
| 5,514,393 | A | 5/1996 | Lynch et al. | 206/222 |
| 5,584,165 | A | 12/1996 | Wright | 426/115 |
| 5,683,732 | A | 11/1997 | Baxter et al. | 426/115 |

FOREIGN PATENT DOCUMENTS

| | | | |
|---|---|---|---|
| DE | 20 02 976 | 7/1970 | |
| EP | 0 690 011 | 1/1996 | |
| GB | 1 266 351 | 3/1972 | |
| GB | 2 280 886 | 2/1995 | |
| WO | WO91/09781 | 7/1991 | |
| WO | WO93/15973 | 8/1993 | |
| WO | WO-95/04689 A1 | 2/1995 | 206/219 |
| WO | WO96/24542 | 8/1996 | |

*Primary Examiner*—Luan K. Bui
(74) *Attorney, Agent, or Firm*—Collard & Roe, P.C.

(57) ABSTRACT

The invention provides a container (10) for separately containing a first flowable material (15) and a second flowable material (17) until mixing of the first and second flowable materials is desired comprising: (i) a first chamber (13) containing the first flowable material and having a first head space (14) comprising gas at a pressure greater than or equal; to atmospheric pressure; (ii) a second chamber (16) containing the second chamber (16) containing the second flowable material, the second flowable material containing gas, and optionally, the second chamber comprising a second head space (18) containing gas at a pressure greater than atmospheric pressure; (iii) means for reducing the pressure in the first chamber; (iv) means (20) for transferring gas between the first and second chambers; and (v) means for transferring the second flowable material into the first flowable material when the pressure in the first chamber is reduced.

51 Claims, 18 Drawing Sheets

CONTAINER FOR SEPARATELY STORING FLOWABLE MATERIALS BUT ALLOWING MIXING OF MATERIALS WHEN REQUIRED

CROSS REFERENCE TO RELATED APPLICATIONS

This application is a continuation of U.S. patent application Ser. No. 09/445,651, filed on Feb. 25, 2000, abandoned. Applicants claim priority under 35 U.S.C. §119 of AUSTRALIA Application No. PO 7259 filed Jun. 11, 1997; AUSTRALIA Application No. PO 8538 filed Aug. 14, 1997; AUSTRALIA Application No. PP 0772 filed Dec. 5, 1997; Applicants also claim priority under 35 U.S.C. §120 of PCT/AU98/00429 filed on Jun. 9, 1998. The international application under PCT article 21 (2) was published in English. U.S. Ser. No. 09/445,651, is a 371 of PCT/AU98/00429 filed Jun. 9, 1998.

FIELD OF THE INVENTION

The present invention is concerned with containers for flowable materials, and, more particularly, with containers for liquids in which the pressure is greater than atmospheric. It will be appreciated that carbonated beverages such as the so-called soft drinks and brewed beverages such as beer and cider are contained at super-atmospheric pressure, but the present invention is also concerned with flowable materials (including other liquids) that are, or can be, contained at super-atmospheric pressure. In particular, it is not uncommon for a number of "still" drinks to be packaged in a container containing an atmosphere of nitrogen at super-atmospheric pressure. Examples of the goods which are, or can be, packaged in this way include juices and juice-drinks, milk and milk-based drinks, spirits, wines, iced teas and tea drinks and even medicines and pharmaceuticals delivered in liquid form.

BACKGROUND OF THE INVENTION

In certain alcoholic beverages, particularly stouts, a thick head of creamy froth has long been considered desirable. This head is readily generated when a stout is poured from conventional beer-dispensing apparatus but when stouts are contained in cans (as many other alcoholic beverages frequently are) a head of the same quality is often not produced upon opening the can. This has provided a disincentive to the sale of such beverages in cans but Australian patent No. 577486 provides a solution to this problem. The can described in Australian patent No. 577486 includes an insert which is a gas-filled chamber in communication with the beverage in the can through a restricted orifice. Since the chamber is immersed in the beverage contained in the can a small amount of the beverage will enter the chamber through the restricted orifice so as to equilibrate the pressure in the head space of the chamber and the pressure in the head space of the can. Upon opening the can, the pressure in the head space of the can will immediately be reduced to atmospheric while the procure in the head space of the secondary chamber will remain, momentarily at least, at a pressure greater than atmospheric, hence the gas and/or beverage in the chamber will be ejected through the restricted orifice. This causes gas in the solution to be evolved and form a head of creamy froth on the beverage. The patent does not, however, envisage the introduction of a second liquid into the beverage upon opening of the can, and this would not be possible with the arrangement described since the beverage and any liquid contained in the secondary chamber would be free to mix whilst the can remained sealed.

There are numerous patents and patent applications filed subsequent to Australian patent No. 577486 concerned with the introduction of a head of froth to, beer in a container, but none envisages a container suitable for the introduction of a second liquid to the packaged beverage. However, it would be desirable for a container to be able to contain a second flowable material (such as a powder, suspension or liquid) in a chamber separate to the main chamber of a pressurised container so that it may be introduced subsequently to the beverage in the container. It will be appreciated that such a container, although adapted to introduce a second flowable material to the packaged beverage, could also introduce gas or a separately contained, pressurised beverage into the container so as to cause the beverage to foam.

Such a container is described in international application No. PCT/GB95/01185 in which two such compartments are separated by a membrane capable of being grossly ruptured by the release of pressure when the container is opened. In this case, one compartment contains whisky and the other soda water, hence when the membrane is ruptured a whisky and soda drink is produced. Similarly, U.S. Pat. No. 4,524,078 describes a container including a capsule which either has a separable cap, a frangible wall or in which one wall comprises a wall of the container and the capsule is forced away from the wall of the container when the container is opened. In each case either a wall ruptures, a component of the capsule separates from the capsule or the entire capsule separates explosively from its anchor and may fragment, so in each case there is a potential choking hazard created by the formation of small pieces of the capsule within the beverage in the can. Furthermore, in each case the encapsulated liquid will be released relatively gently through a large orifice into the beverage in the container, so it will diffuse relatively gradually into the beverage. This may result in incomplete mixing and does not provide for spectacular visual effects.

International patent application No. PCT/EP94/02491 describes an arrangement in which a capsule with an orifice in its bottom face is secured in the lower portion of a pressurised beverage can. The capsule contains a second liquid miscible with the primary liquid contained in the can and, to avoid mixing of the two liquids prior to opening of the can, includes a valve stem which seals the orifice in the bottom face of the capsule. The bottom face of the capsule is, however, flexible and when a pressure differential is created by opening the can, the bottom face of the capsule flexes downwardly and the valve stem is dislodged. This allows the second liquid to enter the can through the orifice and mix with the primary liquid. It would be difficult to insert the capsule since it must be pressurised prior to insertion but the open can into which it is inserted will not be pressurised until after it is sealed. Thus there would be practical difficulties in ensuring that the second liquid does not leak through the orifice during insertion. Furthermore, such an arrangement is likely to be subject to pressure fluctuations, for example due to temperature change, in the head space within the capsule. Since there is no means of equalising the pressure within the head space in the capsule with the pressure in the head space within the can, such minor pressure fluctuations will create a pressure differential whenever the temperature of the can changes. This differential will result in small fluctuations in the position of the bottom wall of the capsule and may result in leakage, since it is critical that the orifice remain hard against the valve seat at all times to avoid leakage.

The present invention aims to provide an arrangement for containing a fist flowable material and a second flowable material separately in a pressurised container and for injecting the second flowable material into the first flowable material when the pressurised container is opened. Moreover, having provided such an arrangement, it was recognised that it could also be applicable to injecting gas or a separately contained, pressurised second flowable material into the first flowable material.

SUMMARY OF THE INVENTION

The invention generally provides a container for separately containing a first flowable material and a second flowable material until mixing of the first and second flowable materials is desired comprising:

(i) a first chamber containing the first flowable material and having a first head space comprising gas at a pressure greater than or equal to atmosphere pressure;

(ii) a second chamber containing the second flowable material, the second flowable material containing gas, and optionally, the second chamber comprising a second head space containing gas at a pressure greater than atmospheric pressure;

(ii) means for reducing the pressure in the first chamber;

(iv) means for transferring gas between the first and second chambers; and (v) means for transferring the second flowable material into the first flowable material when the pressure in the first chamber is reduced.

Preferably, the means for reducing the pressure in the first chamber take the form of means for opening the first chamber to an environment external to that chamber, the external environment being at a pressure lower than the pressure in the first chamber before the first chamber is exposed to that external environment. A particularly preferred way of achieving this would be to provide the container with means for opening the first chamber to the atmosphere. Such means could take the form of, for example, a screwable/unscrewable cap fitted to a bottle, a lift off tab for a bottle or can, or a structure located on a wall of the container which is able to be pushed in so as to create an opening in the container communicating between the first chamber and its external environment. Such means would readily be comprehended by persons of ordinary skill in the art. Accordingly, wherever reference is made in this specification and the appended claims to "means for reducing the pressure in the first chamber" is to be understood that such references include a reference to all means of the type discussed in this paragraph.

Preferably, the second chamber has a second head space and the means for transferring the gas between the first and second chambers comprise means for establishing a pressure equilibrium between the first head space and the second head space. It will be appreciated by those of skill in the art that the term "equilibrium" in the context of the balance of pressures between the first and second head spaces should not be taken as implying that the pressures in the first and second head spaces are necessarily equal or approximately equal. In fact, as detailed below, there may actually be a pressure gradient between the first and second head spaces, but nonetheless, an equilibrium will exist between the pressures in the two chambers. In a typical embodiment of the invention, the arrangement would thus be that the pressure in the first chamber (prior to it being opened to its external environment), would be a pressure greater than atmospheric pressure. It is preferred that prior to activating the mixing of the first flowable material and the second flowable material, the pressure in the first and second head spaces is about equal. As explained above however, in other forms of the invention, there may be a difference between the pressure in the first and second head spaces. In embodiments of the invention where such a pressure differential applies, preferably, the difference between the first and second head spaces lies in the range of from about 0.1 to about 10 atmospheres.

Preferably, the pressure in each of the first and second head spaces is at least 0.1 atmosphere, gauge pressure, prior to activation of the container and in order to mix the first and second flowable materials. It is particularly preferred that pressure is at least 0.5 atmosphere, and even more preferably, at least 1 atmosphere. Therefore, the pressure in each of the first and second head spaces is preferably at least one atmosphere above atmospheric pressure, prior to the mixing of the fist and second flowable materials.

It is to be understood that unless the context otherwise requires, wherever used in this specification, the term "flowable material" includes liquids, solutions, suspensions, emulsions, gases and any other forms of matter colloquially referred to or known as a "liquid" or a "fluid", as well as other flowable materials, such as powders. The first and the second flowable materials may be materials of the same physical character, or of different kinds. In one preferred form of the invention, each of the first and second flowable materials would comprise true liquids. In yet other forms of the invention however, the first flowable material could take the form of a true liquid, and the second flowable material could (for example) take the form of a powder. Those of ordinary skill in the art will readily appreciate that many other combinations are possible, and are embraced within the scope of the present invention. Such persons would also readily appreciate that the flowable material in either chamber could—prior to mixing with the flowable material in the other chamber—also constitute a combination of two or more flowable materials (eg, a liquid containing a gas).

Preferably, the means for transferring the second flowable material comprise a conduit means extending from within the reservoir of the second flowable material in the second chamber into the first head space. Alternatively, the conduit may terminate within the first flowable material, in which case it would be desirable to include a siphon breaker arrangement such as a small orifice in the conduit means within the first head space. More preferably, the conduit means passes through the second head space.

Preferably, the conduit means comprise a structure through which the flowable material may travel. Preferred structures for this purpose include tubes, and channels (including enclosed and open channels). Alternatively, the structure could take the form of one or more bores formed through a wall or like partition separating the two chambers of the apparatus. A particularly preferred conduit means would include a capillary structure, such as (for example), a capillary tube. In this regard, it is to be understood that wherever used in this specification, the term "capillary" includes not only structures or apparatus which are thin or of hair-like configuration, but also, other structures or apparatus which are capable of employing a capillary action.

In a particularly preferred embodiment of the invention, the means for equilibrating pressure comprises a small orifice in the conduit means within the second head space. The orifice may be a round hole but could equally well be an oblate or square hole, a slot, or the like. It will be appreciated that gradual pressurisation and depressurisation of the second head space occurs when the orifice is present since the orifice is in direct fluid communication through the conduit means and the orifice in its end (or the orifice operating as a siphon breaker) with the first head space. However, when rapid depressurisation of the first chamber occurs, a pressure differential will be created between the first chamber and the second chamber as the orifice is sufficiently small that a large pressure differential such as created when the first chamber is opened to the atmosphere cannot be equilibrated instantaneously. Accordingly, there will an initial flow of the second flowable material through the conduit means, and the initial flow will quickly block the small orifice. Thus, the pressure differential created by opening the first chamber to the atmosphere cannot be equilibrated and flow of the second flowable material through the conduit means it will continue until there is no longer sufficient pressure differential to drive that flow.

Preferably, the transfer mechanism additionally comprises means whereby the second flowable material travels through the second head space, prior to entering the first chamber. This arrangement would prevent the second flowable material from entering the first chamber by leakage through gravity, unless and until it is transferred from the second chamber by equilibration of pressures between the first and second chambers, as described earlier. In this manner, the container would effectively provide a "liquid lock", thereby preventing premature transfer of the second flowable material into the first flowable material, until transfer is activated in accordance with the invention. Advantageously, the orifice remains above the level of the second flowable material, even if the container is laid on its side. In this arrangement the second flowable material cannot block the orifice at any time except when flow of the second flowable material through the conduit means is induced by opening the first chamber to the atmosphere. This will minimise the possibility of leakage when the container is laid on its side as any small pressure differentials created due to fluctuations in temperature or the like will be quickly equilibrated, irrespective of the orientation of the container.

It may at times be desirable to provide an orifice adapted to be variable in size. For example, the orifice may be fully opened when the first chamber is fully pressurised to ensure that effectively, no pressure differential is created between the first chamber and the second chamber, but the orifice could be restricted or closed when the first chamber is about to be opened to the atmosphere. In the former case this ensures that the orifice is effectively closed by the second flowable material during depressurisation of the first chamber and in the latter case equilibration of pressure is prevented entirely for a period of time prior to opening the first chamber to the atmosphere. In each case, the arrangement facilitates the transfer of the second flowable material whilst minimising the possibility of leakage when the container is in the unopened condition, since the exchange of gases between the first chamber and the second chamber will be enhanced in that condition. This is particularly so because one can use an orifice larger than that which would ensure adequate discharge of the second flowable material if its diameter can be restricted prior to discharge.

The orifice may comprise a slit or valve formed in the capillary. The slit or valve will be closed when the pressure differential between the first chamber and the second chamber is less than a predetermined amount. The predetermined amount is, preferably, between 0.1 atmospheres and 2 atmospheres, gauge pressure. When the pressure in the first chamber exceeds the pressure in the second chamber by more than this predetermined amount, the slit or valve will open and allow the pressure in the two chambers to reach an equilibrium. It will be appreciated by those of skill in the art that in the case of a typical carbonated beverage container made in accordance to the invention, the pressure differential arising when discharge occurs is of the order of 0.5 atmospheres, so this differential will of course, open the small orifice, but the orifice is too small far such a large pressure differential to be equilibrated. The advantage of using a slit which is closed when no pressure differential, or only a small pressure differential less than the predetermined amount, exists, is that leakage of the second flowable material is minimised.

Any other suitable means of equilibrating the pressure between the first head space and the second head space may be employed. For example, the second chamber could be made of or include a portion of a gas permeable plastic such as low density polyethylene, high impact polystyrene, polycarbonate, co-polymers of two or more such plastics materials, or the like. In this embodiment of the invention, diffusion of gas through the gas permeable plastic impregnates the second flowable material in a second chamber containing that flowable material. The entire capsule could be made out of a gas permeable plastic, however, in some applications of the invention, it is preferable to make the capsule out of a plastic which is relatively non-permeable to gas and to make the conduit means (including those parts of it which are in contact with the first head space) out of a gas permeable plastic. In this case, the conduit means does not require an orifice to be formed therein, but rather the gas merely diffuses through the plastic forming the conduit means. Alternatively, a portion of the conduit means may be made of a gas permeable plastic. A particularly suitable gas permeable plastic is low density polyethylene, although other gas permeable plastics are known which are also suitable. Alternatively, part of the capsule (other than the conduit means) could be made out of a gas permeable plastic.

Advantageously, the second chamber floats on the top of the first flowable material, or is fixed to the container at or above the level of the first flowable material. In the case of the container taking the form of a bottle, the second chamber may be fixed to the underside of the cap. In this last mentioned embodiment, the second chamber is preferably located adjacent to or below the cap, but is attached to the neck of the bottle.

In any such arrangement, the second head space and the first head space are separated merely by the walls of the second chamber. In this case it is advantageous for the conduit means to consist of a capillary or a structure otherwise defining a channel. Examples of suitable structures include a gooseneck capillary, or a concentric pipe arrangement. Typically, a capillary or channel-defining structure comprises a first vertical portion extending from within the reservoir of the second flowable material in the second chamber into the second head space, a horizontal portion extending through the wall of the second chamber into the first head space and a second vertical portion within the first head space to direct the second flowable material, when ejected from the second chamber, into the first flowable material. The orifice, to allow equilibration of the pressures in the first and second head spaces, could be in any part of the capillary or channel-defining structure, provided it is above the level of the second flowable material.

Alternatively such a capillary or channel-defining structure may comprise a first vertical position extending from within the reservoir of the second flowable material in the second chamber into the second head space, a horizontal portion within the second head space and a second vertical portion extending from the second head space through the second liquid (but without any means of communicating therewith) and then through a bottom wall of the second chamber into the first head space. The orifice or valve to allow equalisation of the pressures in the first and second head spaces could be in the horizontal portion of the capillary or channel-defining structure, but could also be in either the first or second vertical portions of such a structure provided it is above the level of the second flowable material.

Advantageously, means are also provided to keep the orifice above the level of the second flowable material, even if the container is laid on its side. Typically this is achieved by ensuring that the second flowable material is filled only to a predetermined level and that the orifice is in a position which is above that level, irrespective of the orientation of the container, although of course it will be appreciated the total inversion of the container or some other inappropriate handling could immerse the orifice. It may also be necessary for the container to be packaged in such a way that it cannot be positioned in certain orientations.

There may be more than one such orifice. Advantageously, a first such orifice is located in the first vertical portion not far above the surface of the second flowable material and a second such orifice is located further from the second flowable material in the first vertical portion or in the second vertical portion or the horizontal portion. Thus, should the surface tension in the second flowable material be sufficient for it to move up the capillary far enough to block the first orifice, gas exchange can still occur through the second orifice. A non-wetting agent could be added to the second flowable material or coated onto the inside of the capillary to minimise movement of the second flowable material into the capillary prior to discharge.

A mechanical barrier on the end of the first vertical portion could be employed to prevent entry of the second flowable material into the first vertical portion of the capillary/channel defining structure. A suitable barrier could comprise a cap secured to the bottom wall of the second chamber and able to receive the end of the first vertical portion of the capillary, the cap having a small orifice formed in its side. The first vertical portion of the capillary/structure, when received in the cap, closes the small orifice in the side of the cap but, when it moves away from the bottom of the second chamber, for example when the cap of the container (in this case, in the form of a bottle) is unscrewed, the small orifice is opened. Accordingly, entry of the second liquid to the capillary/structure is prevented while the bottle is closed but opening the bottle brings the end of the first vertical portion of the capillary into a position where the small orifice in the cap is no longer sealed and discharge can occur.

In a particularly preferred embodiment of the invention, the horizontal portion of the capillary abuts the underside of the cap of a bottle and the capillary is adapted for folding movement in the vicinity of the orifice. Typically this folding movement occurs in response to pressure applied, generally manually, to the bottle cap and causes the capillary to fold in such a manner as to restrict or close the orifice. Thus, digital pressure can be applied to the cap of a bottle just prior to opening, or as a part of the opening action, to restrict or close the orifice.

Advantageously, back flow prevention means are provided in the capillary to ensure that the first flowable material does not flow through the capillary into the second chamber, for example, when the container is laid on its side. Such back flow prevention means may comprise a simple flap of a suitable material secured within the capillary in such a manner as to prevent flow of the flowable material from the fist chamber into the second chamber but to allow the flow of the second flowable material from the second chamber into the first chamber. Typically the flap is located in the second vertical portion of the capillary very near its opening to the first chamber. If desired, a one-way valve could be used in place of the flap of material.

Alternative means could be used for transferring the second flowable material. When the second chamber is mounted above the level of the first flowable material, for example, by being fixed to the container or to the underside of a cap, the second liquid may be transferred (for example, by injection) through an orifice formed in a bottom wall of the second chamber. The orifice will be sealed whilst there is no pressure differential between the first chamber and the second chamber but when the first chamber is suddenly depressurised upon opening to the atmosphere, the orifice will be opened. This may be accomplished, for example, by covering the orifice with a burstable sealing strip which ruptures on opening of the container, or by various arrangements of valve means. Suitable valve means for this purpose include an orifice that is opened by relative movement (ie, separation) apart of opposed walls structurally defining or forming part of the bottom wall of the second chamber, poppet valves in the bottom wall and the like.

One particularly suitable arrangement comprises a valve stem fixed in the orifice prior to screwing on the cap of a bottle but adapted for capture by the cap as the cap is screwed on, whereupon when the cap is unscrewed the valve stem is unseated from the orifice. Alternatively, the valve stem may be secured to the cap throughout the closing operation but has a sharp-end which pierces the bottom wall of the second chamber forming the orifice, but sealing it as it is created. Once again, opening cap results in withdrawal of the valve stem from the orifice and so the second flowable material is released. In a yet further arrangement, the means for transferring the second flowable material could comprise a conduit means in the form of a stand pipe which is concentrically located within the second chamber, adapted for capture with the cap of a bottle as the cap is fitted to the bottle, and which also has an associated valve means located at the top or the bottom of the stand pipe, wherein the transfer of the second flowable material into the first flowable material is activated by opening the cap. The opening of the cap may be actuated by unscrewing it, by a lift off mechanism, or by other means which would readily be apparent to those skilled in the art.

In another arrangement that could be used, either the bottom or the top wall of the container is flexible and the orifice is closed by sealing against a valve stem affixed to the top wall of the second chamber opposite the orifice when pressure is equilibrated between the first chamber and the second chamber. However, the bottom wall (or the top wall, as the case may be) flexes when the first chamber is equilibrated and so moves away from the valve stem, thereby opening the orifice.

Alternatively, and this arrangement can be used more particularly where conduit means such as a capillary or channel-defining structure as described above are employed, the top or bottom wall of the container is flexible but seals against the opening of the conduit means to the second flowable material when pressure in the first chamber and the second chamber is equilibrated, but flexes away from it when the first chamber is depressurised.

Yet another possible arrangement has a bottom or top wall which is not particularly flexible but is able to deform sufficiently to form a seal when held against the opening of the conduit means. In this arrangement the conduit means and the bottom or top wall are arranged so as to come into sealing contact when the cap is in sealed disposition on a bottle form of the container but to move away from sealing contact as the cap moves upwardly on the crown of the bottle during the unsealing operation. More particularly, in a screw-cap arrangement, sealing contact is first made as the cap is screwed on after filling the bottle, is maintained whilst the bottle remains capped, and is broken as the cap is unscrewed.

The invention further provides a container for separately containing a first flowable material and a second flowable material until it is desired to mix those materials, comprising:

(a) a first chamber containing the first flowable material, and having a first head space comprising gas at a pressure equal to or greater than atmospheric pressure;

(b) a second chamber containing a second flowable material and comprising a gas at a pressure greater than atmospheric pressure, the second chamber having a base part located generally at or towards a lower part of the first chamber and further comprising conduit means extending from the base part towards the surface of the first flowable material; and (c) means for opening the first chamber to the atmosphere so as thereby to cause the second flowable material to be transferred into the first flowable material.

The container may also comprise means for equilibrating the pressure in the first and second chambers, prior to opening the first chamber to the atmosphere. For example, a tube, channel or other conduit means extending from the second head space to the first head space could be employed for this purpose.

Those of skill in the art will appreciate that in the absence of providing such pressure equilibration means, the pressures in the first and second chambers should be substantially equal. Hence, the second chamber must be introduced into the container at; a time when (i) the second chamber is pressurised and (ii) the first chamber is yet to be pressurised.

The present invention also provides a method of filling a container in accordance with the last mentioned aspect of the present invention, comprising the steps of:

(1) introducing the second flowable material into the second chamber;

(2) pressurising the second chamber;

(3) freezing at least a portion of the second flowable material so as to close the conduit means with frozen second flowable material;

(4) inserting the second chamber in the first chamber and introducing the first flowable material into the first chamber;

(5) sealing the first chamber; and (6) heating the container.

It will be appreciated that upon heating, for example in the pasteurisation process, the plug of the second flowable material closing the conduit means melts. However, an air lock barrier will be set up within the conduit means to partition the second flowable material from the first flowable material, thereby preventing mixing.

Alternatively, a thermoplastic material could be used to form a plug which will melt when the container is heated, or a burstable seal could be provided to close off the conduit means, provided that the seal will burst upon a pressure differential being established between the second chamber, and the first chamber, upon opening of the first chamber to the atmosphere.

It will be appreciated by persons skilled in the art that any of the embodiments of the invention described above may include a plurality of chambers (rather than a single second chamber), capable of delivering a plurality of different flowable materials. It will also be appreciated that different flowable materials could be transferred from different chambers in the same insert or could be transferred from separate inserts.

Typically the second chamber is substantially smaller in volume than the first chamber. In general, it is only necessary to deliver small volumes of the second flowable material to the first flowable material. In general, in the context of a beverage container, between 1 and 90% of the second head space is occupied by the second flowable material.

Typically the first flowable material is a beverage.

In one embodiment of the invention, (in which the container contains a beverage), the second flowable material comprises a colouring such as a 1% solution of tartrazine, sunset yellow, carmoisine or brilliant blue. Advantageously when the container containing the beverage and the tartrazine solution is opened, a colour change to the first liquid (ie, the beverage) occurs, providing a dramatic visual effect which may be transient, persisting only for a few seconds after the bottle is opened, or may be relatively long-lasting. An example of the latter would be a situation where a twist or pattern of colour is produced in the liquid. Alternatively, a substantial volume of coloured liquid may be transferred, so as to create a two-layer effect in the container. Clearly the creation of a two-layer effect is reliant on the second liquid having a density very different from that of the first liquid. In general, the second liquid would be floated on top of the first liquid but if injected from the bottom of the container, the second liquid may constitute the bottom layer of liquid.

The second liquid could also be or contain a flavouring, which may or may not be colourless. Suitable flavouring systems are essential oils in ethyl alcohol compounded flavour chemicals and essential oils with ethyl alcohol and water compounded flavour chemical with propylene glycol and essential oils wetted with wetting agents in, aqueous solution with surfactants. Typically the flavours are present in 0.01–0.2% v/v. Examples of essential oils are citrus oils such as lemon, lime and orange (distilled and cold pressed), and natural spice oils such as cinnamon, buchu, peppermint and the like. Suitable flavour chemicals are in general esters, aldehydes, fatty acids, lactones, and terpene alcohols. Vanillin (4-hydroxy-3-methoxybenzaldehyde) is one example but other suitable flavourings would be well known to the person skilled in the art.

Where two or more liquids are delivered to the beverage the two liquids could, for example, both be colourings, in which case a spectacular visual effect would be created. This would be particularly so if they are injected into the beverage in different positions. Alternatively, both such liquids could be the flavourings, in which case gradients of flavourings could be created, particularly if a thixotropic or thickening agent is also injected into the beverage either together with one or more of the flavourings or separately. Alternatively, each liquid could be a different class of liquid, for example a flavouring and a colouring could be injected at the same time, or at different times, as desired.

It is also possible that a coloured twist as described above, is also flavoured, in which case the flavour will not permeate the entire drink immediately. Thus, gradients of flavour may be created. A typical twist is a twist of juice or juice concentrate.

Colour changes may also be induced in other ways. For example, colour formation by certain food dyes such as cochineal and anthocyanins is pH dependent, and will form different colours depending on whether they are in an acid or alkaline environment. This property could be exploited by containing a beverage at, pH, say, below 7 and using a dye in a weak basic solution as the second liquid. When the container is opened the basic dye solution will be injected into the acidic solution in the container, and will lower the pH of the dye to somewhere below 7, initiating a colour change in the dye. A similar effect could be created by using a chelating agent as the second liquid where the presence or absence of metal ions in the dye effects the colour change in that dye.

Flavour enhancing agents could also be incorporated into the second liquid, for example, the second liquid could constitute an aqueous solution of sugar, a formulated flavour or an artificial sweetener, such as phenylalanine. Whilst this is not particularly advantageous with compounds that are stable in aqueous solution, flavouring agents that are unstable in aqueous solution or flavour enhancers that are unstable in aqueous solution can be added to beverages. This enables these agents to be used when they could not previously be used at all, or had to be added in sufficient quantities to allow for breakdown of a substantial proportion of the compound.

The second flowable material may be any other liquid or other kind of flowable material which it would be desirable to introduce into a beverage. For example, it could be a tea concentrate to be introduced into a juice drink, or vice versa. Another example is the mixing of spirits and a soft drink. The second liquid could also be a thixotropic or thickening agent, a pharmaceutical (and this will be advantageous when, for example, a drug is unstable in aqueous solution but can be stored as a concentrate in ethanol or some other liquid and where it is desirable to administer it by mouth as a dilute aqueous solution or where an undesirable taste in a medicine needs to be masked), quinine concentrate for mixing with carbonated water to create tonic water, or like mixtures.

In some cases where two liquids are mixed, some people prefer more of one liquid and less of the other, or even that one liquid be excluded from the mixture.

Accordingly, the present invention also provides a container in which the concentration of the second liquid in the first liquid can be varied. One means of doing this in the embodiments of the invention where there are means for equilibrating the pressure between the first head space and the second head space, is to provide a bleed hole or valve arrangement in the cap of a bottle. This allows some of the gas from either the first head space or the second head space to be bled gradually. Irrespective of which chamber is bled, the slight pressure differential created will quickly equilibrate so there will be no discharge of the second liquid but the pressure within both head spaces is reduced. Accordingly when the first chamber is opened to the atmosphere there will be created a lesser pressure differential between the second head space and the first head space than would have been created if no gas had been bled. Accordingly, there is a lesser driving force for the second liquid to be expelled from the second chamber. If the pressure in the container has been reduced sufficiently, not all of the second liquid will be expelled from the second chamber so the concentration of the second liquid in first liquid will be less.

Alternatively, if the orifice used to equilibrate pressure between the first head space and the second head space is relatively large, the second liquid will not fully discharge. In this case there will be a tendency to rapid equalisation of pressure when the first chamber is opened to the atmosphere and this will occur to some extent before the orifice is blocked, thus reducing the pressure in the second head space.

Where the second chamber is mounted on the underside of the cap of a bottle it will be appreciated that no opportunity for any further discharge of the second liquid is available if the cap is removed or disposed of. However, if the container is sealed by replacing the cap or if the second chamber is secured within the container, placing a finger over the bottle top and shaking, the second chamber will be pressurized to some extent. When the container is reopened to the atmosphere the second liquid will discharge once again thus, if an extra strong mixture is required instructions could be included on the container to proceed in the manner described above.

Furthermore, one component of a mixture, for example an iced tea concentrate, could be excluded from a juice drink by an arrangement in which, for example, removal of a tab from the bottle cap prior to opening the bottle removes a mechanical blockage from the capillary.

The second liquid may include foaming promoters if it would be advantageous to cause foaming the first chamber when the second liquid is injected therein. Alternatively, the second liquid may contain foaming inhibitors if it is likely that excessive foaming would occur when the second liquid is injected into the first liquid. Suitable foaming inhibitors are lipids, fatty acids, for example oleic acid, and fatty alcohols, for example octanol, and suitable foaming promoters are finely divided salts and powders, proteinaceous materials such as may be derived from barley, and extracts from soapwoods and hops.

Advantageously, the first chamber and/or the second chamber could include active surfaces which promote nucleation. Typically these active surfaces are surfaces on polyolefin structures inserted in the chamber but the entire interior of the chamber could be coated with a polyolefin. In the case of the first chamber, the provision of active surfaces enhances foaming in a beverage contained therein. In the case of the second chamber, the active surfaces maximise decarbonation of the second liquid which provides an additional driving force for discharge of the second liquid.

Tamper proof caps may also overcome the problem of excessive foaming in those beverages prone to this, by allowing the pressure to be released by partially opening the bottle, followed by a separate action to remove the cap fully.

Having provided an arrangement for effectively containing a first flowable material and a second flowable material separately in a pressurised container, and for transferring the second flowable material into the first when the pressurised container is opened, it was found that such an arrangement could also be used to inject gas or a separately contained aliquot of the first flowable material into the major portion of the first flowable material.

Accordingly, in a fourth aspect of the present invention there is provided a container for separately containing a major portion of a first flowable material and a minor portion of a second flowable material (in the form of a liquid or a gas), comprising a first chamber containing the major portion of the first flowable material and having a first head space comprising gas at a pressure greater than atmospheric pressure; a second chamber containing the minor portion of the second flowable material (in the form of a liquid or gas), the gas pressure in the second chamber being at greater than atmospheric pressure; means for transferring gas between the first chamber and the second chamber; means for opening the first chamber to the atmosphere; and means for injecting the minor portion of the second flowable material into the major portion of the first flowable material, when the first chamber is opened to the atmosphere.

The other features of the invention described above with reference to the introduction of a second flowable material (typically a liquid) into a first flowable material (typically also a liquid) are equally applicable to this embodiment of the invention, the exception being that where a gas is injected into the first flowable material (where that material is a liquid), the conduit means for introducing the gas must extend to below the surface of the first flowable material. Preferably, such conduit means extend almost to the bottom of the container (which is typically a bottle). Other adaptations are described with reference to FIGS. 15*a–c,* 16*a–c* and 17*a–c.*

Moreover, some of the arrangements described above are suitable for delivering a second liquid into a first liquid, a minor portion of the first liquid into major portion of the first liquid, or a gas into the first liquid in arrangements which do not have means for equilibrating the pressure between the first chamber and the second chamber. That is to say, a prepressurised second chamber can be inserted in a bottle or other form of container suitable for use in the invention, and can deliver its contents via the arrangements described above, and such arrangements also constitute a part of the present invention.

BRIEF DESCRIPTION OF THE DRAWINGS

Preferred embodiments of the present invention will now be described, by way of example only, with reference to the accompanying drawings, in which.

DETAILED DESCRIPTION OF PREFERRED EMBODIMENTS OF THE INVENTION

Figure 1:
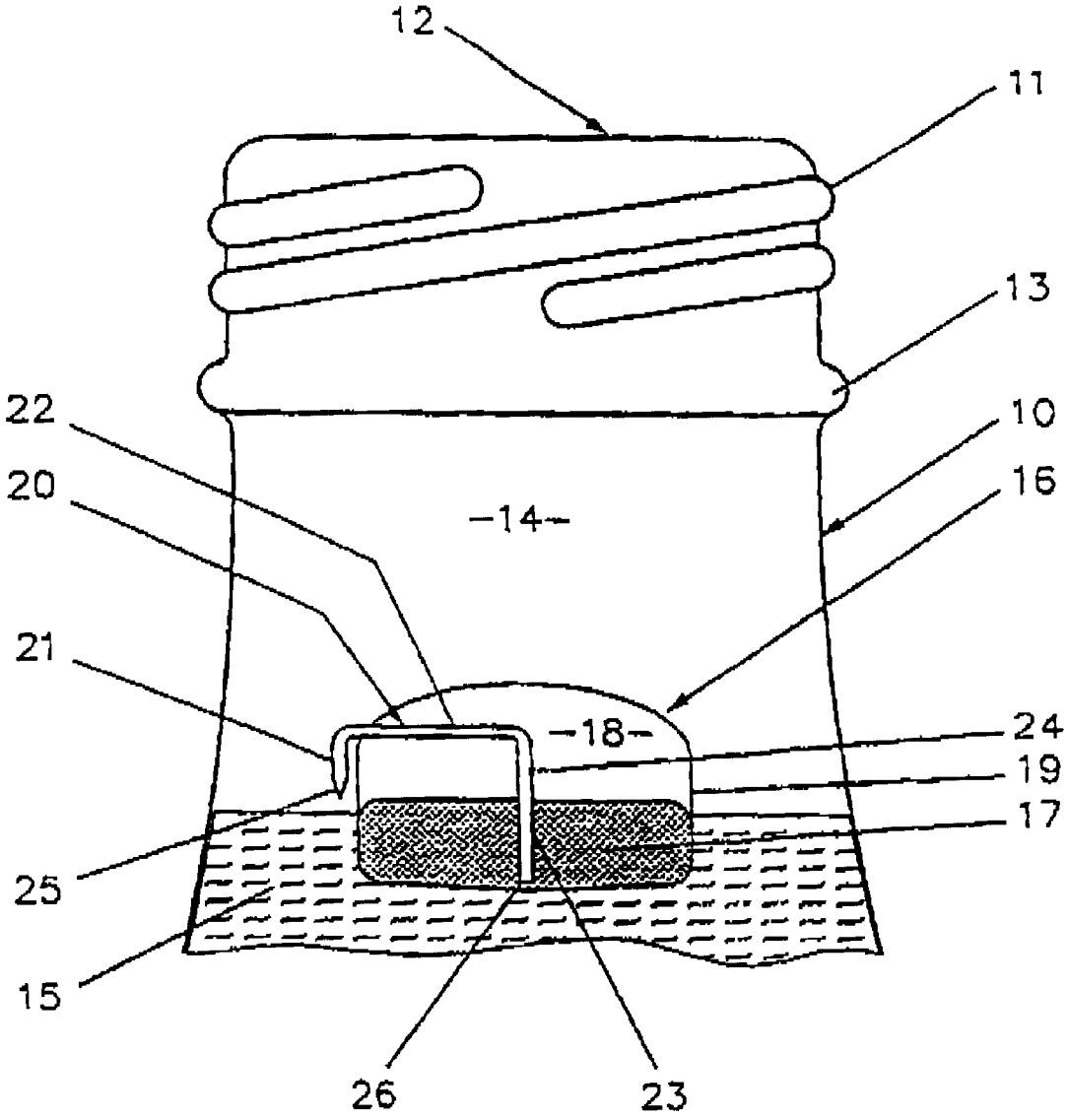
FIG. 1 is a cross-section through the upper portion of a container (in the form of a bottle) in accordance with the present invention.

FIG. 1 illustrates a bottle 10, which constitutes a first chamber, with a screw thread 11 for receiving a screw cap (not shown) formed above flange 13 so as to seal the opening 12 to the bottle. The bottle is filled close to the bottom of flange 13 with a first flowable material (in the form of a liquid 15), but a first head space 14, comprising gas at a pressure greater than atmospheric pressure when the bottle is sealed, is left above the first liquid 15. In general, the first liquid 15 is a carbonated beverage and so the head space 14 pressurises upon sealing of the bottle due to evolution of gas from the first liquid 15 but if the first liquid 15 is a "still" beverage it is common practice to pressurise the bottle with nitrogen or the like.

In this embodiment of the invention an insert 16 floats on first liquid 15. The insert 16, which constitutes a second chamber, generally has a thermoplastic wall 19 enclosing a space which comprises a second flowable material (in the form of a liquid 17) and second head space 18. The insert 16 has conduit means, in this case, in the form of a gooseneck capillary 20, extending from the first head space 14 through wall 19 and into the interior thereof. The gooseneck capillary comprises a first vertical portion 23, a horizontal portion 22, which extends through the wall 19 of the insert 16, and a second vertical portion 21. Second vertical portion 21 has an opening 25 to the first head space 14. Furthermore, the, gooseneck capillary 20 includes a small orifice 24, and the ratio of the diameter of the gooseneck capillary 20 to the diameter of orifice 24 is about 15:1. In the embodiment shown the orifice 24 is in the first vertical portion 23 of the gooseneck 20, and this portion of the gooseneck capillary 20 also includes orifice 26 opening into the second liquid 17.

Figure 2A:
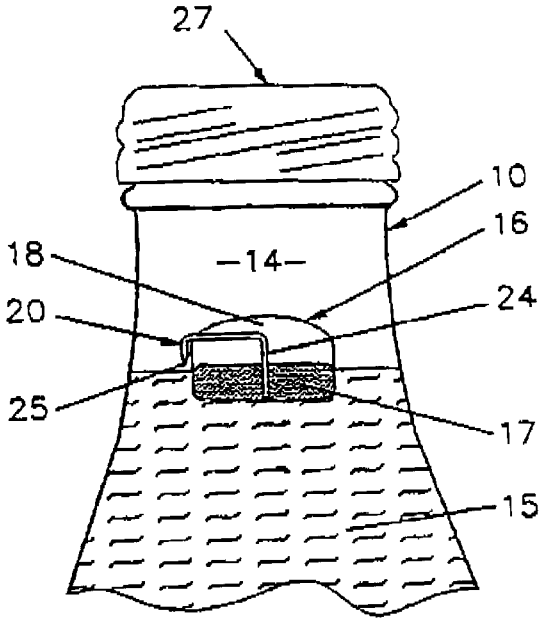
FIGS. 2*a–c* illustrate discharge of the insert shown in FIG. 1.
Figure 2B:
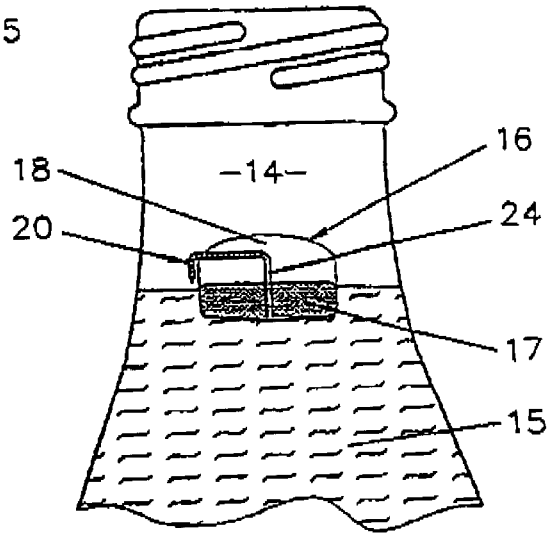
Figure 2C:
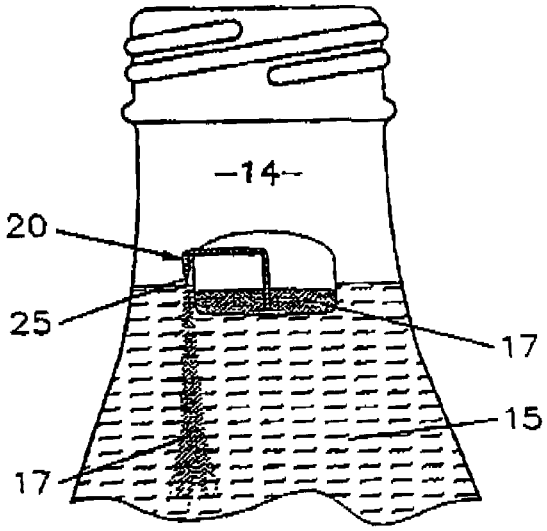

The manner of discharge of the insert 16 shown in FIG. 1 is illustrated in FIGS. 2*a–c*. In FIG. 2*a* the bottle is shown capped with cap 27, hence the bottle 10 is pressurised. The pressure within the bottle 10 may be anything up to 5 atmospheres in normal use, dependent on the beverage contained therein. With the bottle 10 in the sealed condition, as shown in FIG. 2*a,* the pressure in the head space 14 of the bottle 10 is in fluid connection with the second head space 18 in the insert 16 way of inlet 25 to the gooseneck capillary 20, the gooseneck capillary 20 and the small orifice 24 formed in the gooseneck capillary 20. This small orifice is sufficiently small that any pressure differential between the first and second head spaces is not equilibrated immediately, but equilibrates gradually over time. However, where there are small fluctuations in the pressure in first head space 14, perhaps as a result of minor temperature changes when a cold room or refrigerator is closed or opened, such changes are readily equilibrated without discharge of the second liquid 17.

As shown in FIG. 2*b,* when the cap 27 is removed the pressure in first head space 14 immediately drops to atmospheric pressure. The small orifice 24 cannot equilibrate such a large pressure differential immediately. Thus, the pressure differential created by opening the bottle 10 to the atmosphere initiates a flow of the second liquid 17 into gooseneck capillary 20. The second liquid 17 quickly reaches small orifice 24 and blocks any further exchange of gases through this orifice. There now remains no means of equalising the pressure differential between the first head space 14 and the second head space 18 other than by discharge of the second liquid 17. Accordingly, discharge of the second liquid 17 continues until the pressure differential no longer exists.

As best seen in FIG. 2*c,* the second liquid 17 quickly flows through outlet 25 from gooseneck capillary 20 and does so as a jet of liquid since there is a substantial driving for created by the large pressure differential generated. Thus the second liquid 17 surge through the first liquid 15, and if it is relatively miscible therewith, mixes rapidly. On the other hand, if the second liquid is not particularly miscible (perhaps as it has minimal solubility in the first liquid or because it is substantially more viscous than the first liquid), visual effects can be created where the second liquid is a colouring, or gradients of flavour can be created where the second liquid is a flavouring. Typically, a twist of a coloured flavouring agent such as a juice or cordial can be created. Alternatively, a formerly transparent drink can be coloured if a miscible colouring is added or a drink can be coloured changed if a colour change additive, as described previously, is injected.

Figure 3:
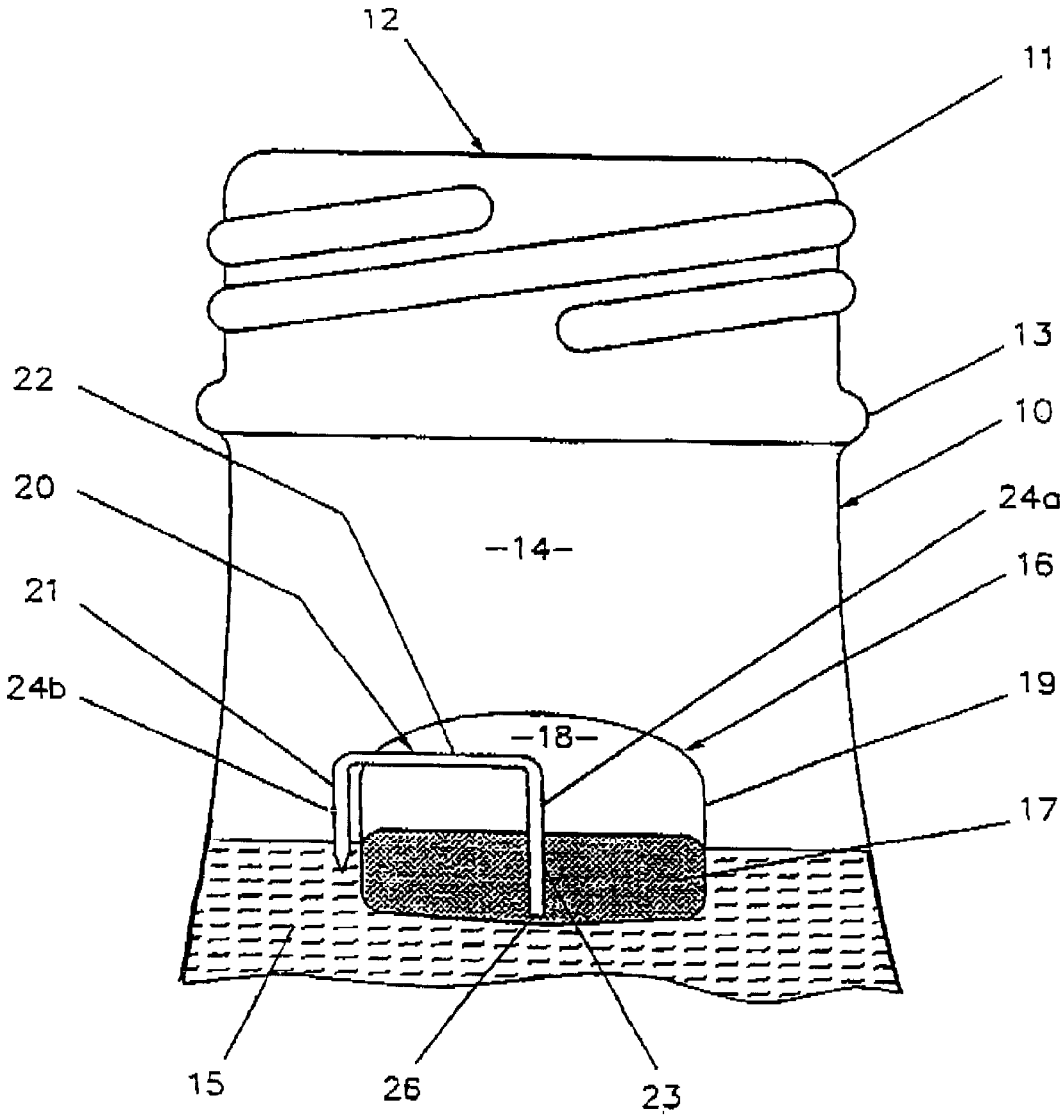
FIG. 3 is a cross-section through the upper portion of a bottle in accordance with a further embodiment of the present invention.

A variant of the embodiment of the invention shown in FIG. 1 is illustrated in FIG. 3. In view of thy similarity between the two embodiments, the same reference numerals have been used for similar features. In fact, the two embodiments differ only in that second vertical portion 21 of the gooseneck capillary terminates beneath the surface of the first liquid 15, and in that second vertical portion 21 includes a second orifice 24*b*. The second orifice 24*b* communicates with first head space 14, hence allows pressure equalisation between the two head spaces 14 and 18. The manner of discharge of the insert 16 is as described previously with reference to FIGS. 2*a–c* except that the second liquid 17 is discharged directly into the first liquid 15 rather than into first head space 14.

FIG. 4, FIG. 5, FIG. 6 and FIGS. 7*a–c* illustrate embodiments of the invention similar to that described above with reference to FIGS. 1, 2*a–c* and 3 but wherein the insert is mounted on the underside of the cap of the bottle. Accordingly, the same reference numerals will be used for similar features in these FIGS.

Figure 4:
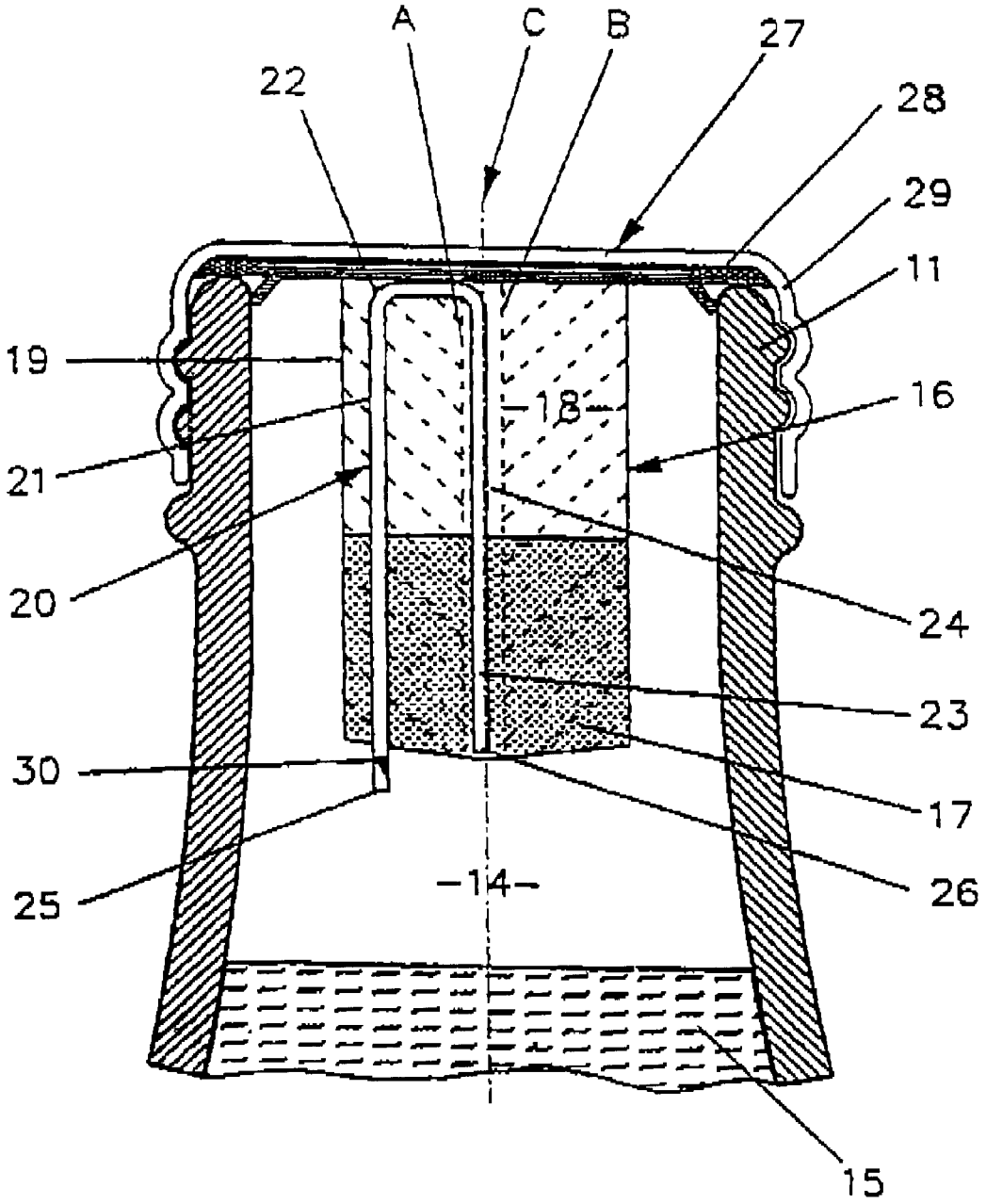
FIG. 4 is a cross-section through the upper portion of a bottle in accordance with a still further embodiment of the present invention.

In FIG. 4, cap 27 is seen to comprise a thread engaging portion 29 with a sealing section 28 on its underside. The insert 16 is secured to the underside of sealing section 28 in any convenient manner, for example, using adhesive or by thermally bonding it thereto, or by attaching it to the thread or moulded features of the cap. On this occasion the gooseneck capillary 20 has a first vertical portion 23, including orifice 24, extending from the reservoir of second liquid 17 (and including an opening 26 thereto) into the second head space 18 as in FIG. 1. However, the, horizontal portion 22 of the gooseneck capillary 20 does not pass through the wall 19 of the insert 16, rather the second vertical portion 21 of the gooseneck capillary 20 commences within the second head space 18, passes through the second liquid 17 without communication therewith and then through the wall 19 into the first head space 14. Towards the end of second vertical portion 21 a flap 30 of a suitable material is arranged so as to prevent flow of first liquid 15 into the gooseneck capillary but so as to allow the flow of second liquid 17 through outlet 25, thus the flap 30 acts as a back flow prevention means. It will also be appreciated that the level of second liquid 17 is such that it will not cover orifice 24 if the bottle is laid on either side. The dotted line A represents the level of the second liquid 17 if the bottle 10 were laid on its left side as illustrated in FIG. 4 and the dotted line B illustrates the level of second liquid 17 if the bottle were laid on its right side as illustrated in. FIG. 4. The gross hatched regions beneath each of these lines shows the area of the inside of the insert 16 which would be covered, and it will be apparent that orifice 24 is not covered when the bottle is laid on either side. This is because the insert 16 in this case is filled to only about 40% of capacity and, with the first vertical portion 23 of the gooseneck capillary 20 positioned a little to the left of centre line C but with the orifice 24 on its right side (and so virtually centred), the orifice 24 is not covered. This is advantageous because, irrespective of the orientation of the bottle, small pressure differentials between the first head space 14 and the second head space 18 can be equilibrated.

The first vertical portion 23 of the gooseneck capillary 20 in this case has fold lines (not shown) to either side of orifice 24. Furthermore, horizontal portion 22 of the gooseneck capillary 20 abuts the underside of the cap 27. Thus, pressure applied in the direction of arrow C to the point directly above the horizontal portion 22 of the gooseneck capillary will be transferred to the first vertical portion 23 and act on the folds to either side of the orifice 24, causing the capillary to fold thereby closing or restricting orifice 24. If the orifice 24 is closed completely prior to opening the bottle it will be appreciated that there is no opportunity whatsoever for, the pressure in the first head space 14 and the pressure in the second head space 18 to equilibrate before the second liquid 17 surges into the first liquid 15 through the gooseneck capillary 20. On the other hand, if the orifice is merely restricted, it will be appreciated that there will be less opportunity for any substantial equalisation of pressure and gas exchange through the orifice 24 will be more easily prevented when the second liquid 17 surges into the first vertical portion 23 of the gooseneck capillary 20.

Figure 5:
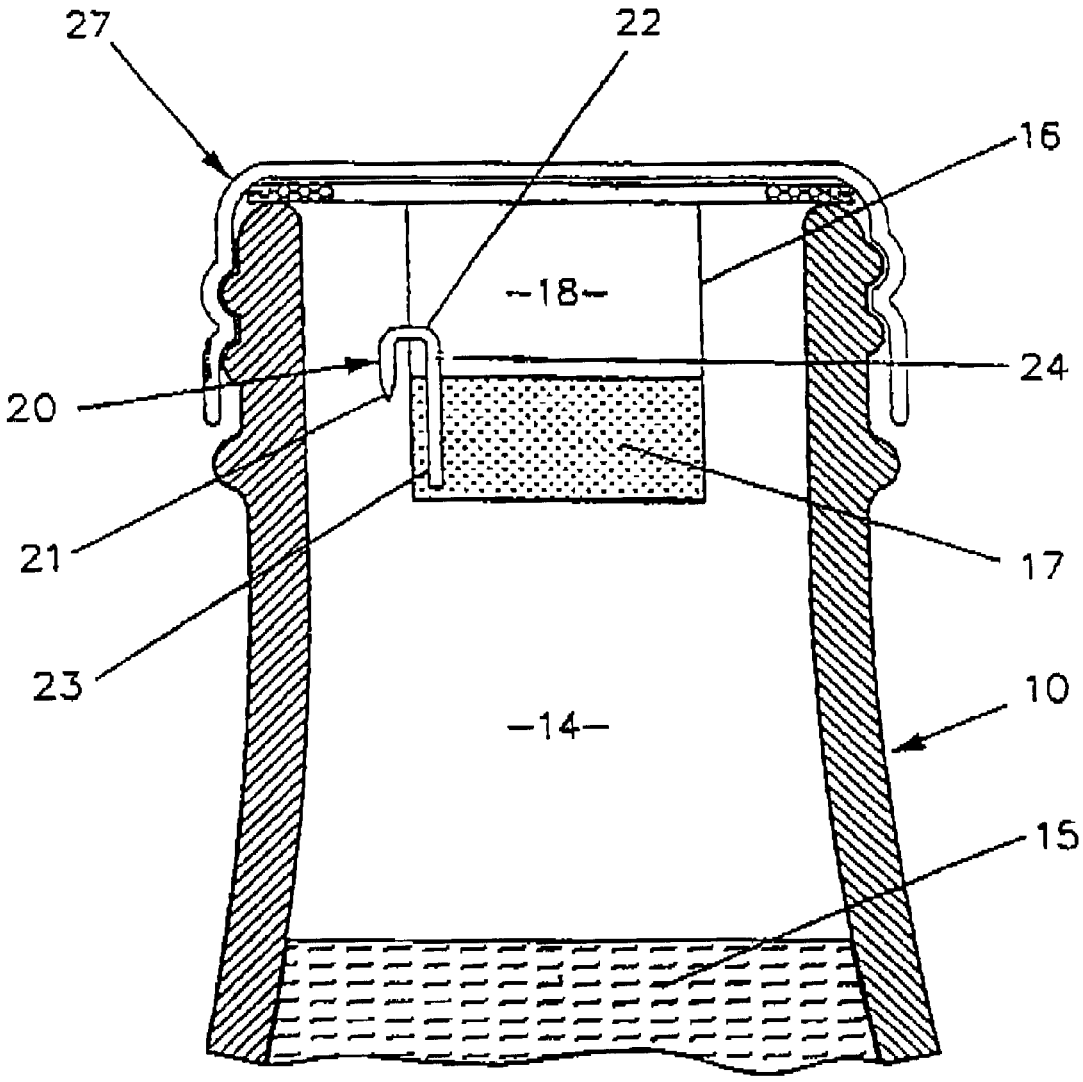
FIG. 5 is a cross-section through the top portion of a bottle in accordance with a still further embodiment of the present invention.
Figure 6:
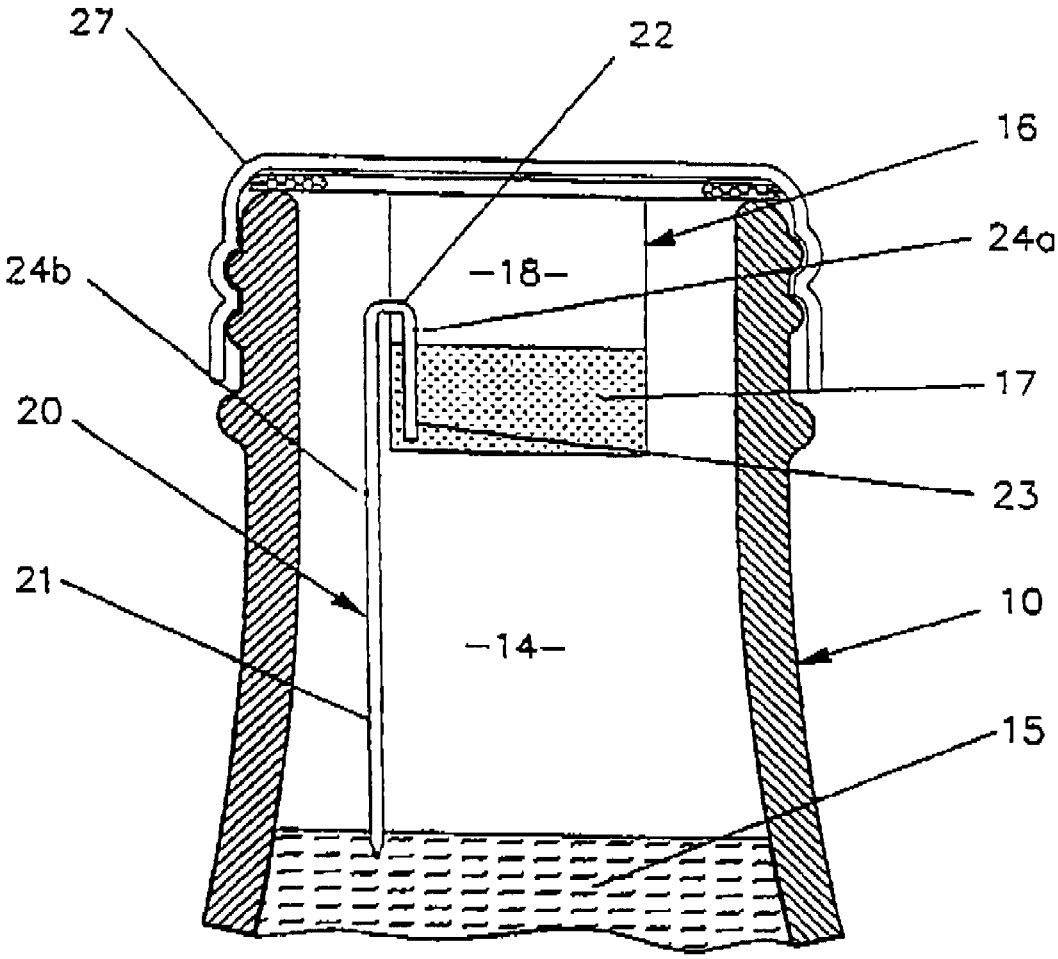
FIG. 6 is a cross-section through the top-portion of a bottle in accordance with a yet another embodiment of the present invention.

FIGS. 5 and 6 each illustrate an insert 16 similar to that shown in the previous FIGS., but with the first vertical portion 23 of gooseneck capillary 20 positioned close to the wall 19 of insert 16 instead of centrally. As a result, the horizontal portion 22 of the gooseneck capillary 20 is reduced in length. In FIG. 5, the second vertical portion 21 of the gooseneck capillary 20 terminates in first head space 14 but in FIG. 6 it terminates beneath the surface of the first liquid 15. Accordingly, the gooseneck capillary 20 in FIG. 6 includes a second orifice 24*b* and the first orifice is designated 24*a*. The function of the second orifice 24*b* is as described with reference to FIG. 3.

Figure 7A:
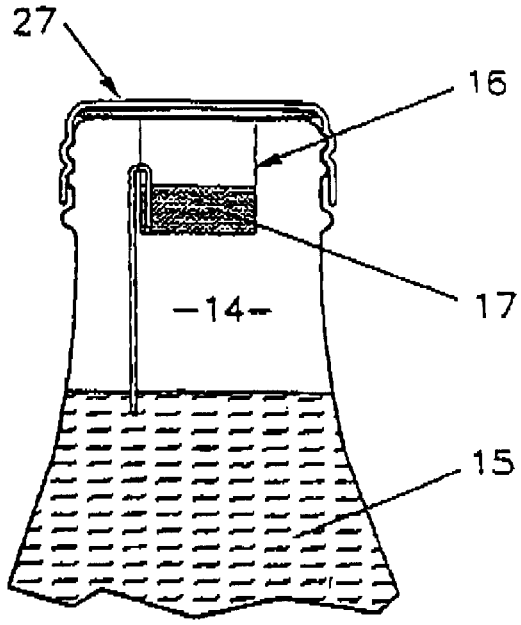
FIGS. 7*a–c* illustrate the manner of discharge of the insert shown in FIG. 6.
Figure 7B:
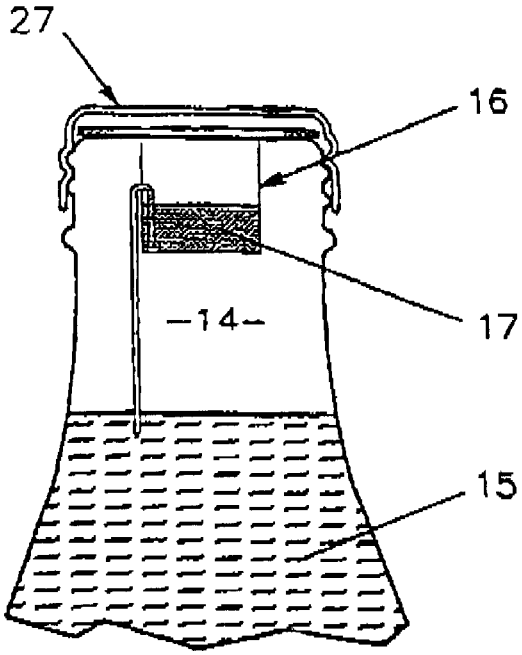
Figure 7C:
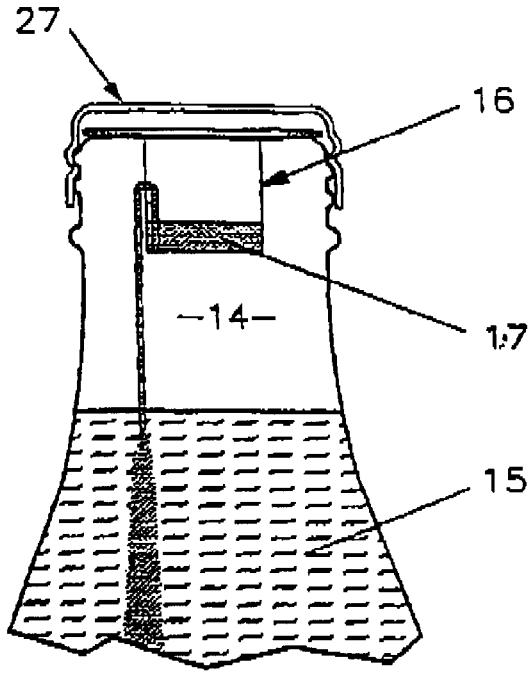

The discharge of the insert 16 of FIG. 6 is shown in FIGS. 7*a–c* and occurs in substantially the same manner as the discharge of the insert shown in FIG. 3 and described in connection with FIGS. 2*a–c*. The major difference in the manner of discharge is that cap 27, shown sealed in FIG. 7*a,* is loosened in FIG. 7*b* but not removed completely at this stage. In general tamper evident caps are removed in two stages, a first stage in which a seal is broken which releases the pressure in the bottle and a second stage in which the cap is unscrewed. The release of pressure in the first step is sufficient to initiate injection of the second liquid 17 into first liquid 15 as seen in FIG. 7*c*. The discharge is sufficiently rapid that it will be completed before the cap is completely unscrewed. The insert shown in FIG. 5 discharges in a similar manner but injects the second liquid 17 into the first head space 14.

Figure 8A:
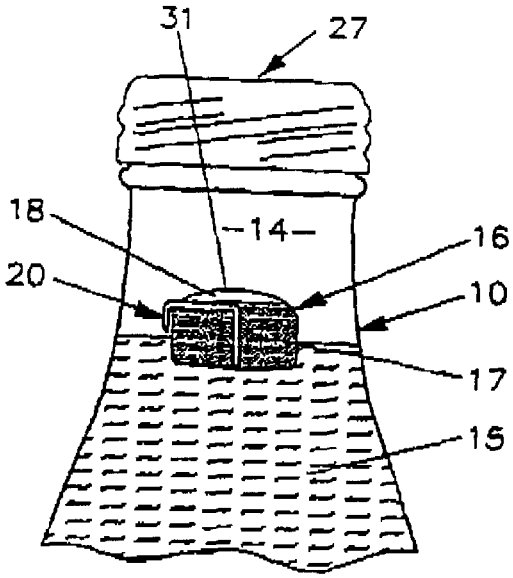
FIGS. 8*a–c* illustrate the discharge of an insert in accordance with yet another embodiment of the present invention.

The embodiment of the invention illustrated in FIGS. 8*a* is once again similar to that illustrated in FIGS. 2*a–c*. The insert 16 in this case includes a gooseneck capillary 20 which does not have the small orifice 24 formed therein, rather a portion of the top surface 31 of the insert 16 is made of a gas permeable plastics material such as nylon, polyethylene or PET so that the second liquid gradually becomes saturated with gas permeating there through from the first head space 14. In this case gas dissolves in the second liquid as the gas diffuses through the gas permeable plastic, until the second liquid is saturated. Upon removal of the cap 27 the second liquid 17 will tend to liberate the gas dissolved therein but it will not pass through the gas permeable membrane rapidly, so the second liquid surges into the gooseneck capillary 20 with this as its driving force. A gas permeable plastic patch could be used in other embodiments of the insertion also including those (such as shown in FIGS. 4 and 5) where the insert is mounted on a bottle cap.

Figure 9A:
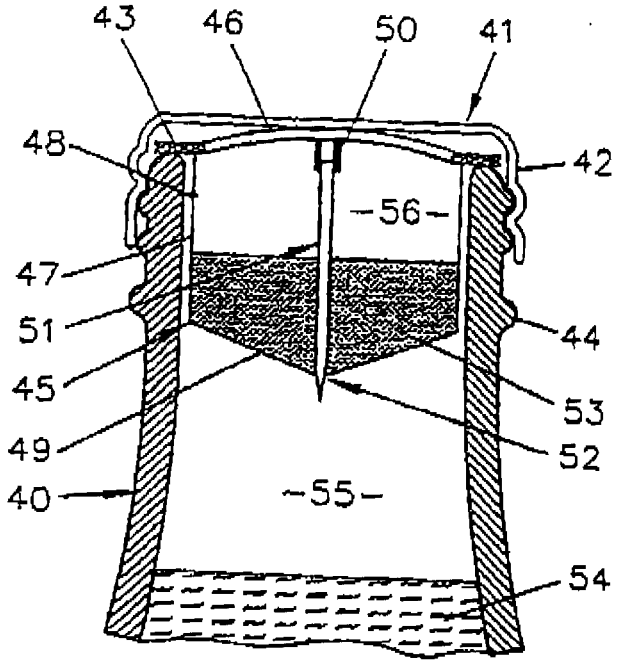
FIGS. 9*a–c* illustrate the discharge of an insert in accordance with still another embodiment of the present invention.
Figure 9B:
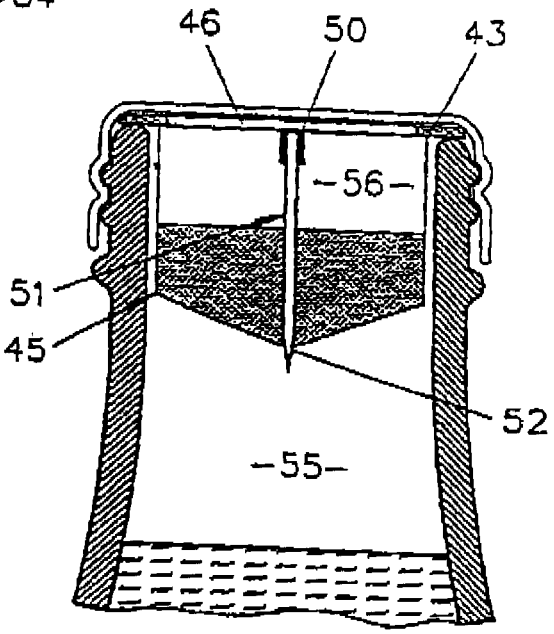
Figure 9C:
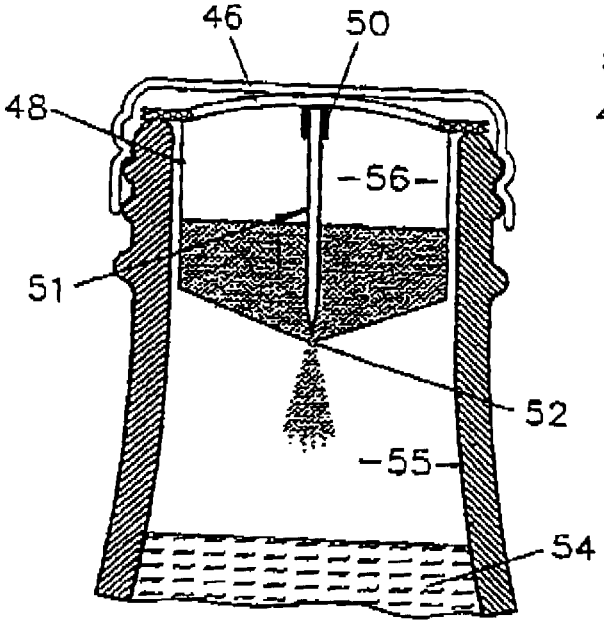

The embodiment of the invention illustrated in FIGS. 9*a–c* comprises a bottle 40, the interior of which constitutes a first chamber, capped by a cap 41 comprising a thread engagement portion 42 and a sealing portion 43. The sealing portion 43 is made of a resilient material such as a thermoplastic. The thread engaging portion 42 of the cap engages thread on bottle 40. The bottle 40 includes flange 44 above which the cap 41 sits when in the fully sealed position.

The sealing portion 43 of the cap 41 has an insert 45, constituting a second chamber of the container, attached to its underside. Furthermore, a portion of the sealing portion 43 of the cap 41 constitutes a top wall 46 of the insert 45. Side wall 47 of the insert 45 has a small orifice 48 (although a valve or a gas permeable patch could be used to ensure that the second liquid 53 does not flow out of the insert 45 when bottle 40 is laid on it side) formed therein and the bottom wall 49 is generally conical in shape. Top wall 46 has a barrel 50 formed thereon and a valve stem 51 secured within the barrel but seated within the barrel 50 in a position spaced from the base of the barrel. The valve stem 51 is anchored in orifice 52 in the bottom wall 49 of the insert 45, and so seals the orifice.

When the cap 41 is screwed onto bottle 40, the sealing portion 43 of the cap 41 deforms, hence the upper wall 46 of the insert 45 also deforms. Deformation of the upper wall 46 would tend to push valve stem 51 in a downward direction but it is anchored in orifice 52, hence the movement that occurs is for the end of the valve stem 51 secured within barrel 50 to move to a position abutting the base of the barrel 50. The valve stern 51 is secured in this position and, as seen in FIG. 9*c,* will be held in the position when the cap is unscrewed again. However, the upper wall 46 deforms once again but this time valve stem 51 moves with it, since it is firmly held at the base of barrel 50. The result is that orifice 52 is opened and the second liquid 53 is injected in the first liquid 54. In this embodiment of the invention, as in previous embodiments of the invention, pressure is equilibrated between the first head space 55 and the second head space 56 by way of the exchange of gas through orifice 48. Although the orifice 48 is never blocked in this embodiment of the invention, the orifice is sufficiently small or takes the form of a pressure sensitive opening or valve that it cannot equilibrate a large pressure differential rapidly.

Figure 10A:
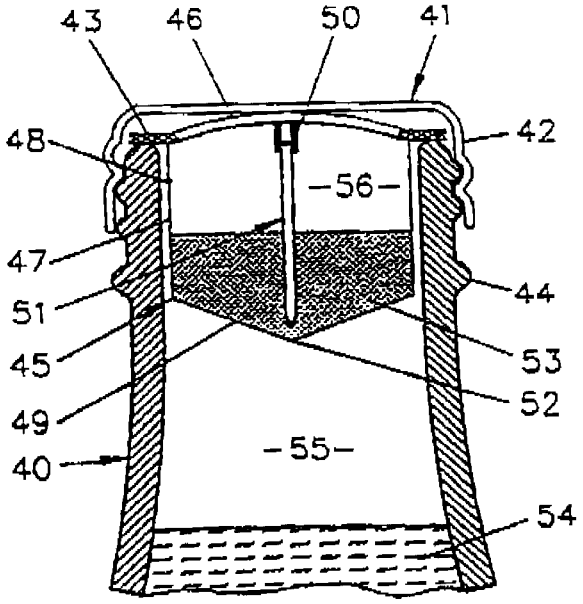
FIGS. 10*a–c* illustrate the discharge of an insert in accordance with still another embodiment of the present invention.
Figure 10B:
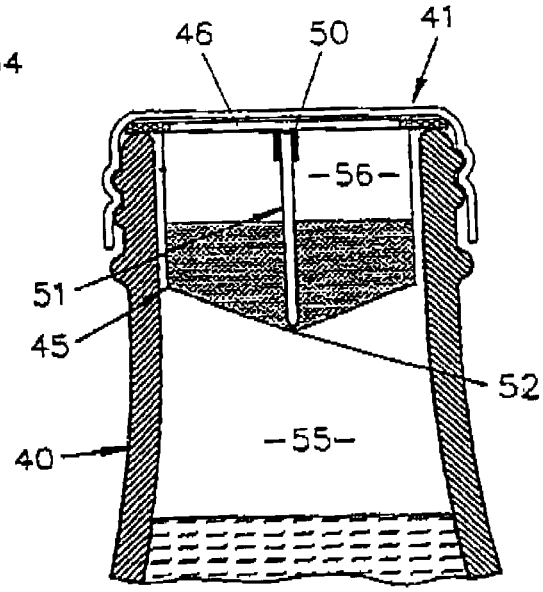
Figure 10C:
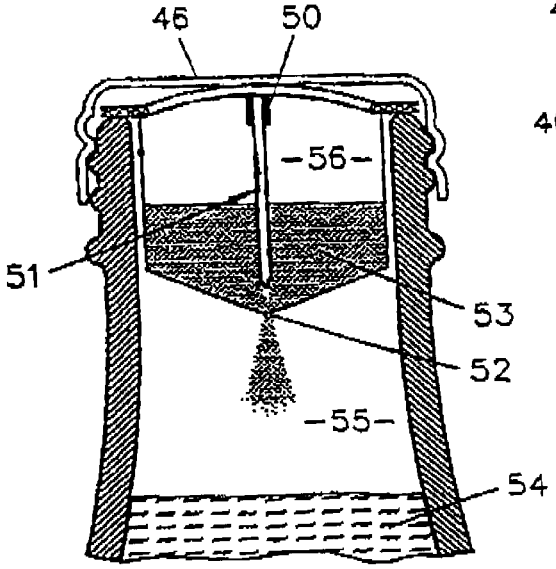
Figure 11:
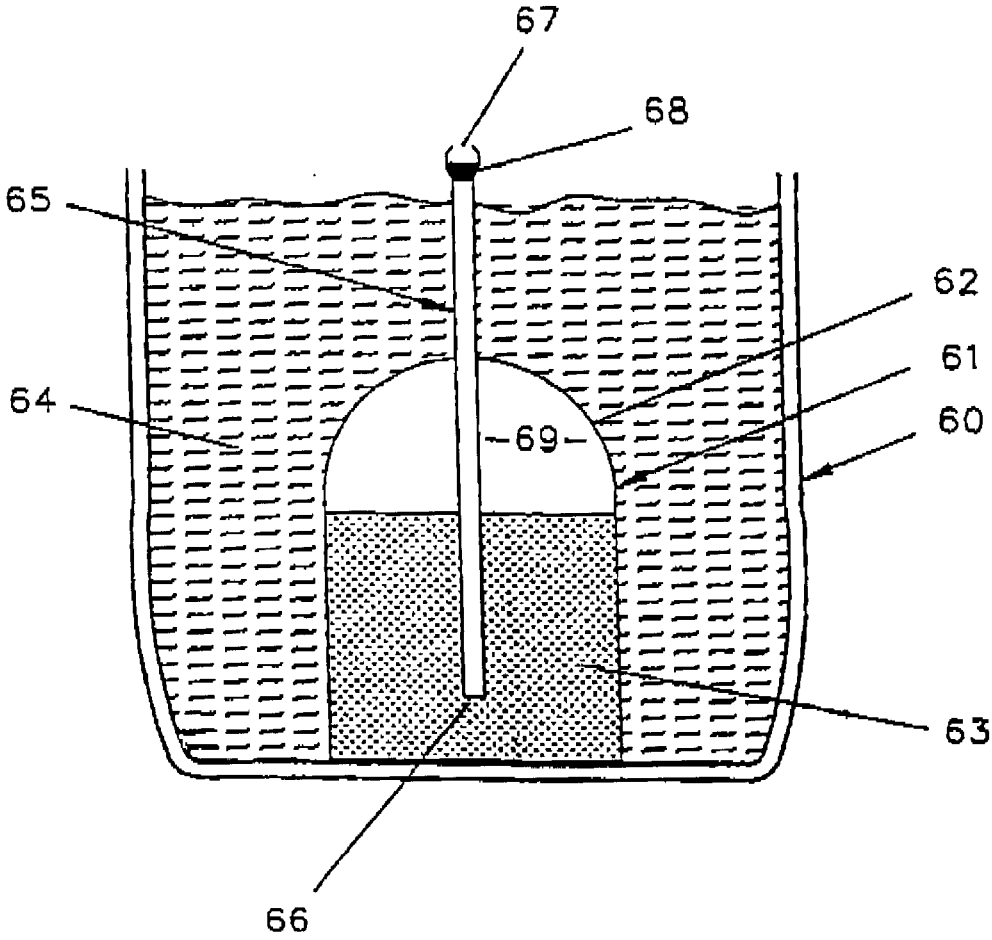
FIG. 11 is a cross-section through the bottom portion of a bottle in accordance with still another embodiment of the present invention.

FIGS. 10*a–c* illustrates a similar insert to that shown in FIGS. 9*a–c,* hence the same reference numerals have been used for similar features. However, in this case valve stem 51 has a sharp end which can perforate the bottom wall 49 at point 52, which thereafter becomes orifice 52, when it is moved into contact with it (as shown in FIG. 10*b*) by screwing the cap 41 onto bottle 40. Valve stem 51 is firmly secured within barrel 50 abutting its base in FIG. 10*a,* and remains in this position throughout the sealing and opening operations illustrated, as withdrawal of the valve stem 51 from the newly created orifice 52 (see FIG. 10*b*) results in release of the second liquid 53. This is shown in FIG. 10*c,* where it is ejected through orifice FIG. 11 illustrates an embodiment of the invention in which the bottom of the first chamber, in this case bottle 60, includes an insert 61 constituting a second chamber. The insert 61 has a wall 62 which allows it to contain second liquid 63 within its base portion 64. The insert 61 also has conduit means, in this case capillary 65 extending upwardly from the base part. The capillary 65 is straight and is in communication with the second liquid 63 through orifice 66. At its upper end, it has an orifice 67 in communication with the first liquid but the end also has back flow prevention means, in this case a flap of material 68, which acts to prevent the influx of first liquid into the capillary, at its end. The pressure in the second head space 69 and the first head space (not shown) above the first liquid 64 is substantially equal but there is no means of allowing these pressures to equilibrate.

In order to place the insert 61 in the bottle 60, the insert is allowed to suck up a second liquid 63 through capillary action and this is done in a pressurised atmosphere with the pressure being substantially what would be expected in the sealed bottle. The second liquid 63 is frozen whilst the insert 61 is pressurised and inserted into the bottle 60. The bottle 60 is then filled and sealed. During the pasteurisation process, the bottle 60 is heated whereupon the plug of frozen second liquid melts. Since the pressure inside the insert 61 has been chosen to be substantially equal to the pressure within the bottle 60, there is no substantial driving force for the second liquid to be injected into the first liquid 64 even after the plug melts. Instead, an airlock will be created within the capillary 65 and this prevents mixing with the first and second liquids. The flap of material 68 provides a back up system to prevent first liquid 64 following into the insert 61 in the event that temperature fluctuations cause a relatively large increase in the pressure in the first head space.

Figure 12:
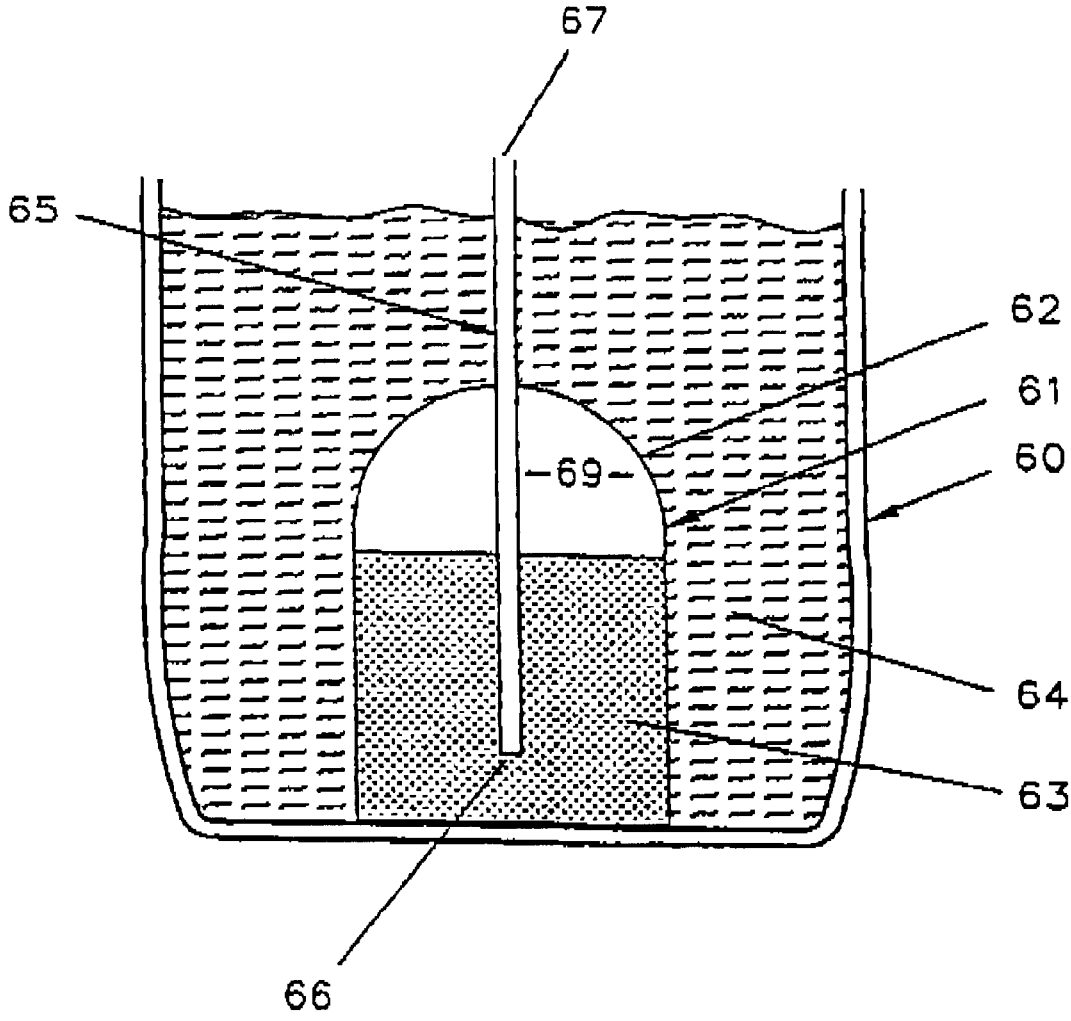
FIG. 12 is a cross-section through the bottom portion of a bottle in accordance with still another embodiment of the present invention.

The embodiment of the invention shown in FIG. 12 is similar to that shown in FIG. 11 except that the flap 68 of material is omitted.

Figure 13A:
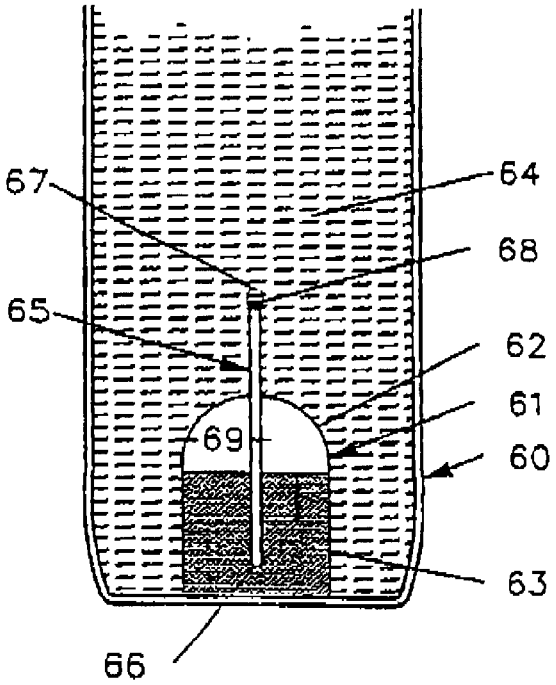
FIGS. 13*a–c* illustrate the manner of discharge of the insert shown in FIGS. 10 and 11.
Figure 13B:
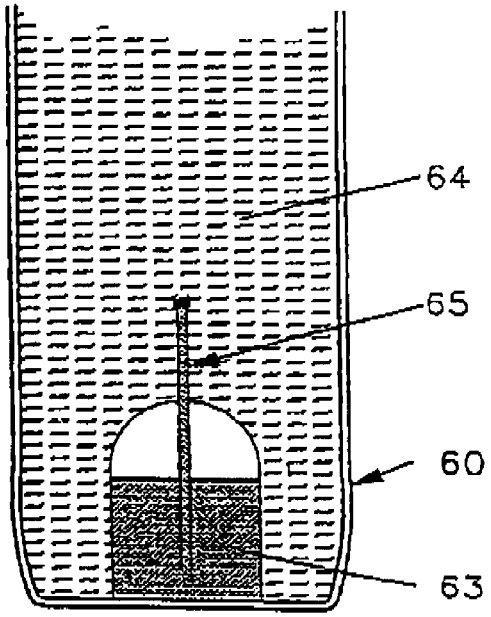
Figure 13C:
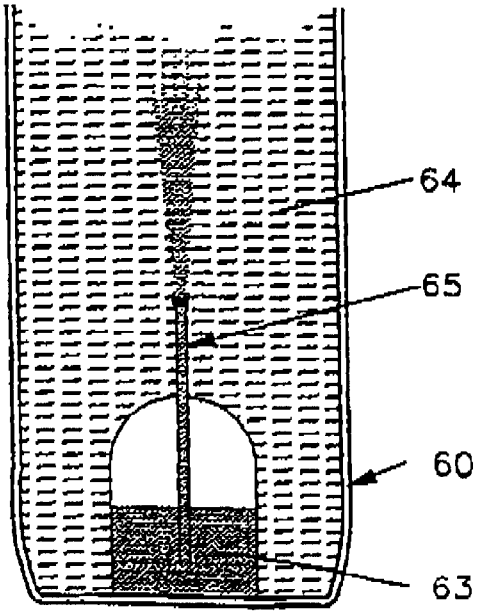

As shown in FIGS. 13*a–c,* discharge of the contents of the bottle 60 occurs when the cap—(not shown) is removed. The pressure in the bottle head space will be quickly reduced to atmospheric with the result that the airlock in the capillary 65 will no longer resist the second liquid 63, which will be injected into the first liquid 64 from the base of the bottle 60.

The embodiment of the invention illustrated in FIGS. 14*a–d* is the same as shown in FIG. 4 with the exception that it includes a cap 80 secured to the bottom wall of the insert 16. The cap 80 includes a small orifice 81 in its side, approximately half way up the cap. The cap has an open top and is generally cylindrical in cross-section. Accordingly, it is able to receive the lower end of first vertical portion 23 of the gooseneck capillary 20 (see FIG. 14*d,* which depicts an exploded view of the physical position and arrangement of the first vertical portion 23 relative to cap 80, bottom wall of the insert 16 and small orifice 81 in the container depicted in FIG. 14*a*).

Figure 14A:
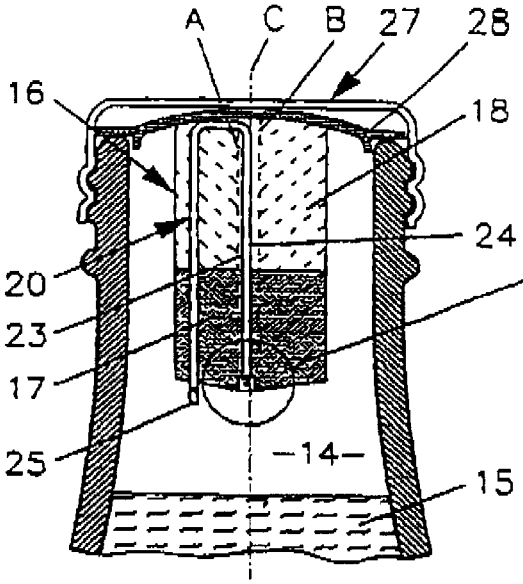
FIGS. 14*a–d* illustrate the manner of pressurisation and discharge of a modification of the insert shown in FIG. 4.
Figure 14D:
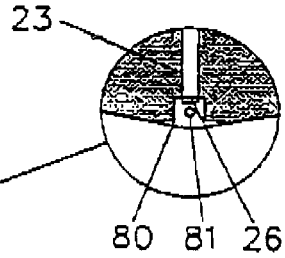
Figure 14B:
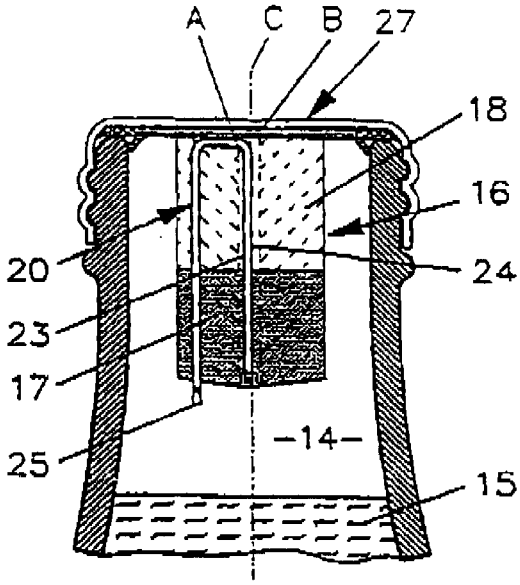

The opening 26 to the first vertical portion 23 as can be seen in FIG. 14*b* to be positioned substantially against the bottom of the cap 80, and comparison to FIG. 4 shows that the opening 26 does not seal tightly against the bottom wall of the insert 16. Accordingly, in the FIG. 4 embodiment small quantities of the second liquid 17 can enter the gooseneck capillary 20. Where there are temperature fluctuations the liquid can move along gooseneck capillary 20 and some leakage of the liquid can occur.

With reference to FIG. 14*a,* it can be seen that, as the cap 27 is screwed onto the bottle, the sealing section 28 on its underside acts on horizontal portion 22 of the gooseneck capillary 20 to push it in a downward direction. The end 26 of the first vertical portion 23 enters the cap 80 but at this point is not juxtaposed to small orifice 81. Hence, small orifice 81 remains open and there is fluid communication between the interior of the second chamber and the interior of the first vertical portion 23 through small orifice 81 and opening 26 to the first vertical portion 23.

In FIG. 14*b,* the cap 27 is now tightly sealed on the bottle, and the first vertical portion 23 has been pushed far enough into cap 80 that a side wall of the first vertical portion lies hard against the small orifice 81. Accordingly, the small orifice 81 is closed and, in any event, the opening 26 to the first vertical portion 23 is pressed hard against the bottom of the cap 80.

Figure 14C:
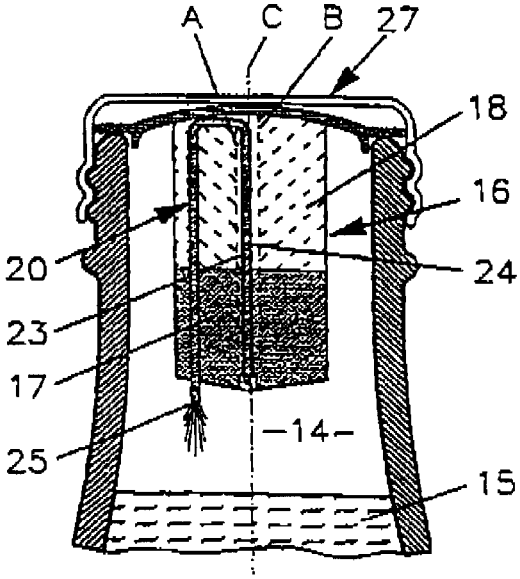

Upon opening of the bottle, as seen in FIG. 14*c,* the downward pressure on first vertical portion 23 (see FIG. 14*d*) of the gooseneck capillary 20 is released and it once again moves in an upward direction, opening the small orifice 81 and allowing the second liquid to flow through the small orifice 81 into the cap 80 and then through opening 26 into the first vertical portion 23 of the gooseneck capillary 20. Since there is simultaneous depressurisation of the first chamber 14, discharge of the second liquid 17 occurs.

Figure 8B:
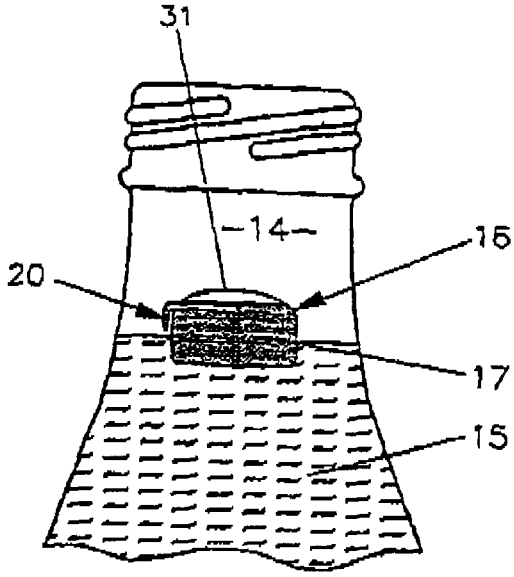
Figure 8C:
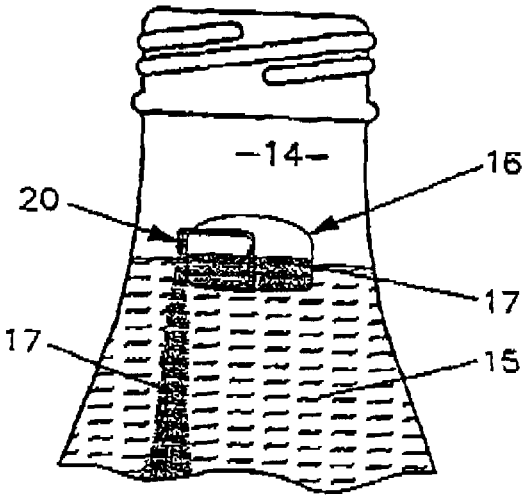
Figure 15A:
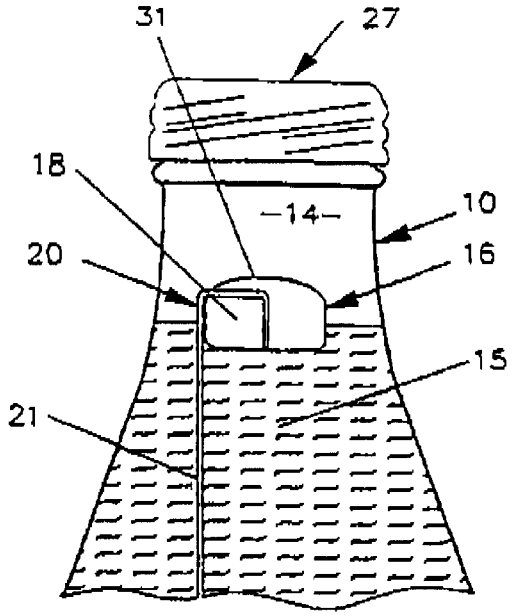
FIGS. 15*a–c* are similar to FIGS. 8*a–c* but illustrate an embodiment of the invention in which a gas is injected into a liquid contained in the bottle.
Figure 15B:
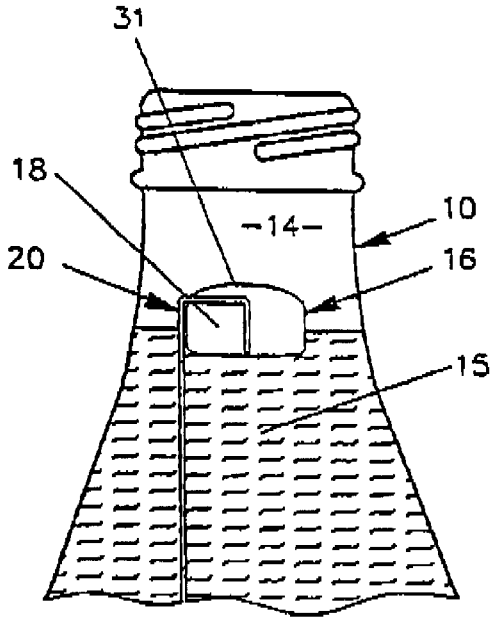
Figure 15C:
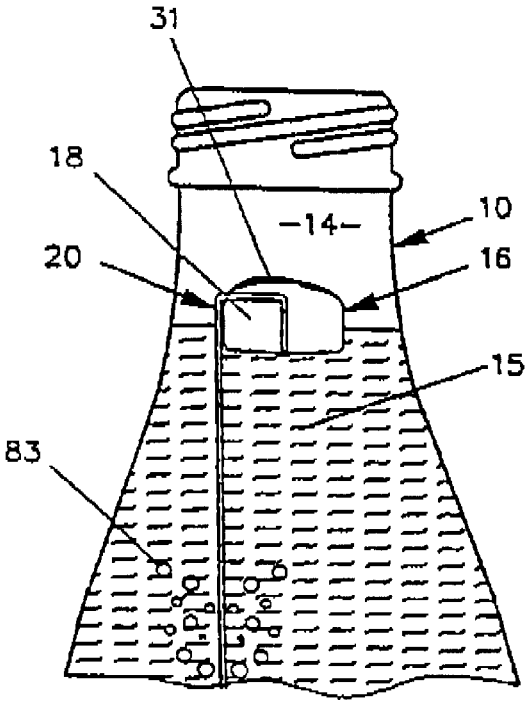

The embodiment of the invention illustrated in FIGS. 15*a–c* is identical to that shown in FIGS. 8*a–c,* with the exception that the second vertical portion 21 of the gooseneck capillary 20 extends virtually to the bottom of the bottle 10. The manner of discharge illustrated in FIGS. 15*a–c* is identical to that described with reference to FIGS 8*a–c,* with the exception that there is no liquid in the insert 16. Accordingly, when discharge occurs gas from insert 16 passes through gooseneck capillary 20 to where it terminates near the bottom of the bottle 10, and forms bubbles 83 in the outlet from the gooseneck capillary. The small bubbles formed act as nucleation sites for further bubble formation, and within a few seconds of opening the bottle, a substantial head of foam is generated in the bottle.

It will be noted that the portion of the top surface 31 made of a gas permeable material could be replaced by a small orifice, as in FIGS. 1 and 2*a–c.*

Figure 16A:
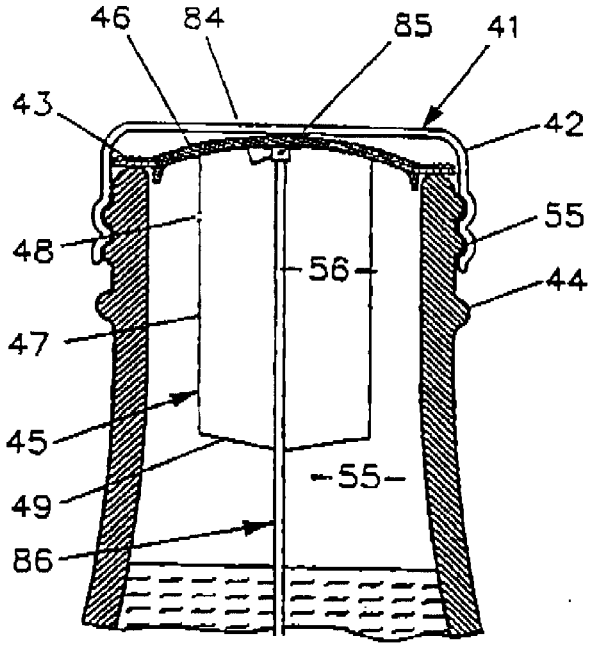
FIGS. 16*a–c* illustrate a further embodiment of the invention wherein gas is injected into a liquid contained in a bottle.
Figure 16B:
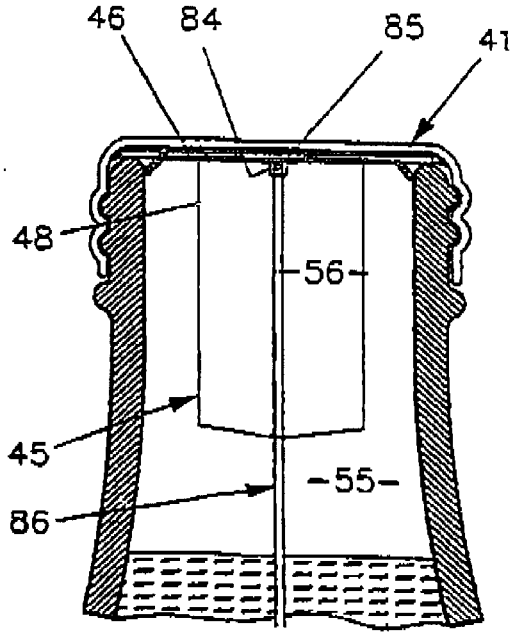
Figure 16C:
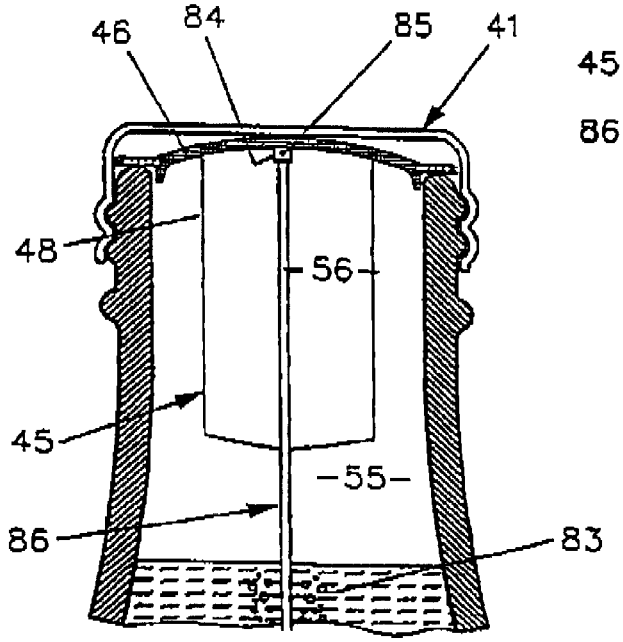

The embodiment of the invention shown in FIGS. 16*a–c* is conceptually similar to that shown in FIGS. 14*a–c* but also resembles the embodiment of the invention shown in FIGS. 9*a–c* and the same numbering is used in that embodiment as been used here. In this case, cap 84 replaces barrel 50 and capillary tube 86 replaces valve stem 51. Capillary tube 86 is not captured in cap 84 as valve item 51 is in barrel 50 in the embodiment shown in FIGS. 9*a–c.* Instead, cap 84 includes small orifice 55 which, when cap 84 is pushed downwardly by sealing portion 46 of cap 41 when the cap is screwed on, orifice 85 is closed by the side of capillary tube 86. This is seen in FIG. 16*b.* Once the cap is re-opened, capillary tube 86 is once again able to slide out of cap 84, thereby opening small orifice 85 and placing the interior of the insert 45 in fluid flow connection with the interior of the bottle 40. Thus, discharge of gas from the insert 45 can occur through capillary tube 86. Once again, the discharge is to a point near the bottom of the bottle 40 and bubbles 83 are generated in the beverage contained in the bottle 40.

Figure 17A:
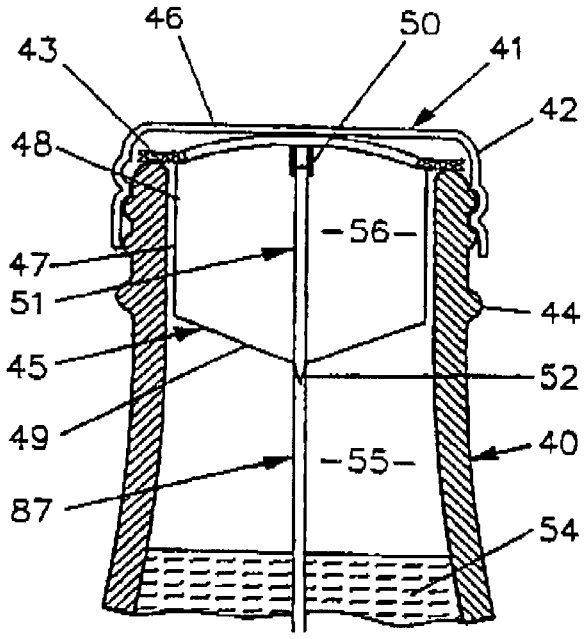
FIGS. 17*a–c* show the embodiment of the invention illustrated in FIGS. 9*a–c* adapted to inject gas into a liquid contained in the bottle.
Figure 17B:
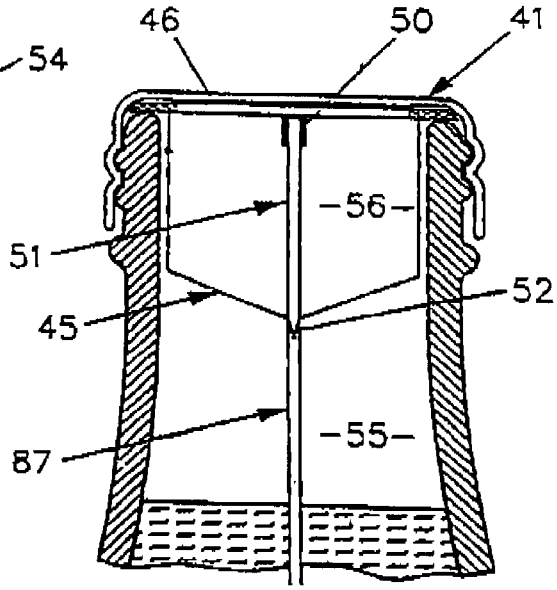
Figure 17C:
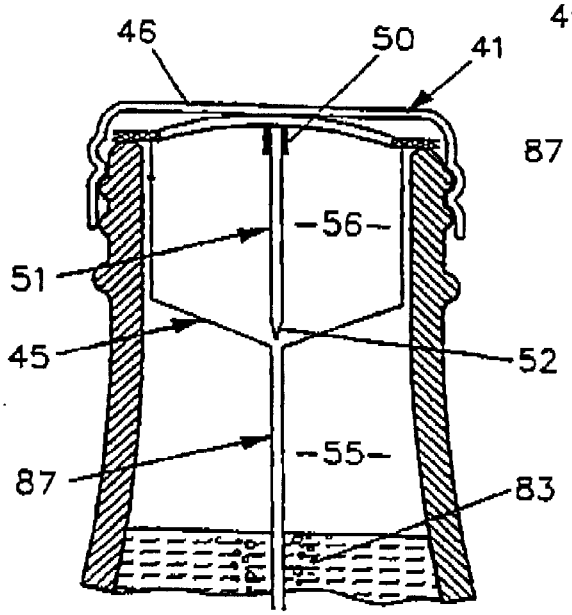

FIGS. 17*a–c* are similar to the embodiment of the invention shown in FIGS. 9*a–c* so the same numbering has been used. In this case a valve stem 51 has one end 52 mounted within capillary tube 87 and the other end is adapted for capture in barrel 50. The capillary tube 87 extends from the insert 45 almost to the bottom of the bottle 40, commencing at the apex of the underside 49 of insert 45. Hence, prior to capture of the valve stem 51 in the barrel 50, as shown in FIG. 17*a,* the end 52 of valve stem 51 resides within capillary tube 87. When the cap 41 of the bottle is screwed on, the valve stem 51 is captured by barrel 50, but the end 52 of the valve stem 51 remains disposed within capillary tube 87. However, when the cap is unscrewed, the end 52 of the captured valve stem 51 slides out of the capillary tube 87 and the gas encapsulated within insert 45 surges down capillary tube 87 and into the beverage. Once again bubbles 83 are generated in the beverage with the result that a head of foam is produced.

Figure 18A:
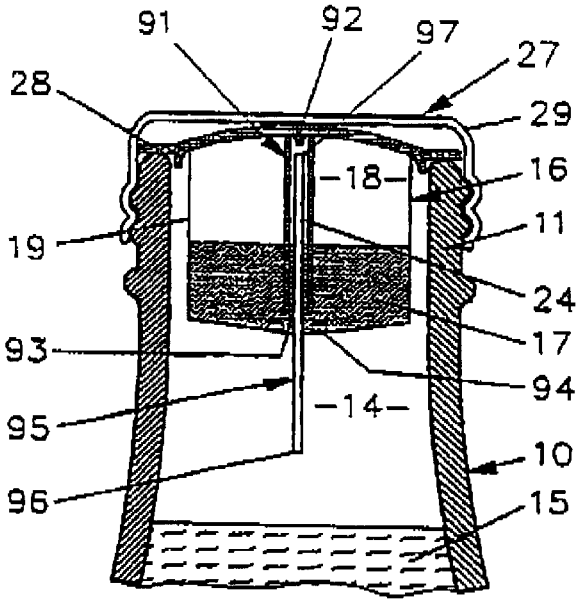
FIGS. 18*a–c* illustrate the mode of operation of a yet further embodiment of the invention.
Figure 18B:
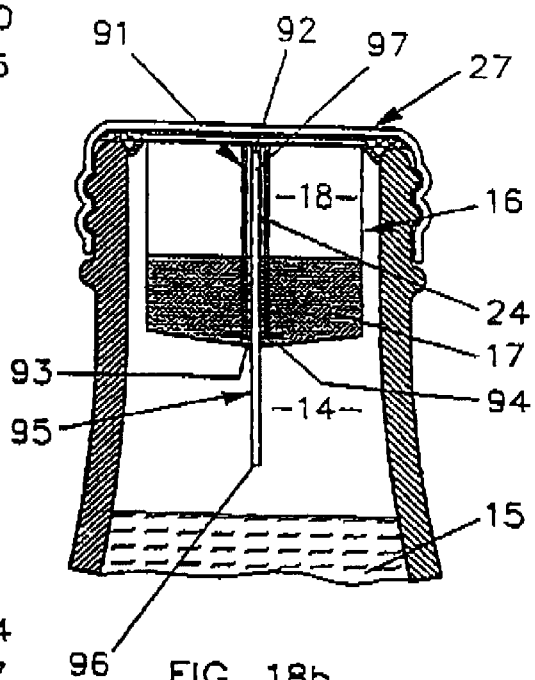
Figure 18C:
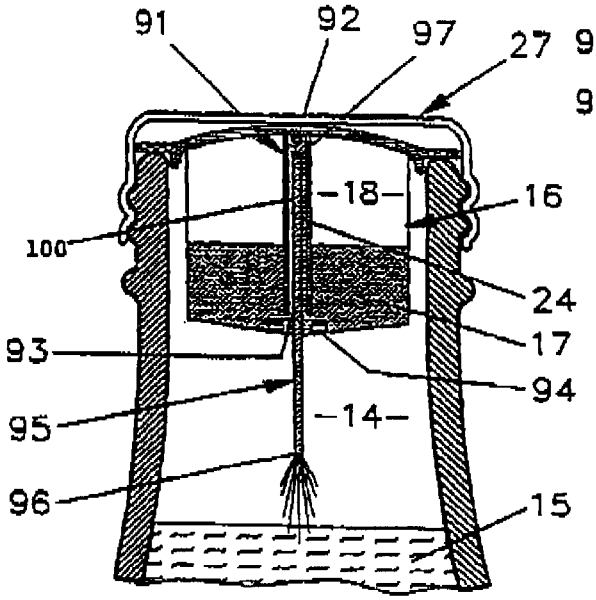

The embodiment of the invention shown in FIGS. 18*a–c* is conceptually similar to that shown in FIG. 4 and FIGS. 14*a–d,* and so in describing this further embodiment, the same numbering system as has been used in describing earlier embodiments has also been used in the following description. As shown in FIGS. 18*a*–18*c,* in this further embodiment of the invention, the gooseneck capillary structure that forms the conduit between the two chambers In FIG. 4 and FIGS. 14*a–d* is replaced with a capillary conduit formed from concentrically arranged structures, in the form of standpipes 91 and 95. The concentrically arranged structures may take any desired shape when viewed in cross section, but will often conveniently have a generally circular cross sectional shape.

The capillary conduit means adopted in the embodiment shown in FIGS. 18*a–c* includes a standpipe 91 which is connected at its upper end to the insert 16, (the upper portion of which, in the illustrated embodiment, is located below the bottle cap 27), and which at its other end, defines an outlet 93 which is immersed in the second flowable material 17. Positioned concentrically within standpipe 91 is another stand pipe 95, which communicates between the head space 18 of the second chamber through the bottom wall of insert 16 and into the head space 14 of the first chamber. This second standpipe has an opening 96 at its lower end, which as shown in FIGS. 18*a–c,* is located in the first chamber head space 14, and an opening 97 at its other end, which is located in the head space 18 of the second chamber, near the top of standpipe 91. Located on one wall of standpipe 95 at a position above the liquid 17 is an insert 16 and below the outlet 97 is a small orifice or slit 24 which functions in a manner similar to that of the orifice 24 described in FIG. 4. As shown particularly in FIG. 18*a,* insert 16 is fitted with a protrusion 92 on its underneath surface. As shown in FIGS. 18*a* and *b,* protrusion 92 is located so as to engage the upper end of standpipe 95, and to seal that standpipe, in use of the apparatus shown. At the bottom of insert 16 is a concentrically arranged collar 94 connected to the bottom wall of the insert and shaped to capture opening 93 of standpipe 91, in use of the apparatus, in the manner hereafter described.

When the cap 27 is screwed onto the bottle in the manner shown in FIG. 9*b* (and as earlier described herein), projection 92 engages entrance 97 of the inner standpipe 95, thereby effectively sealing it. Simultaneously, the outer standpipe 91 also moves downwards and its entrance 93 is captured in projection 94 on the bottom wall of insert 16.

This effectively seals the flow path of second flowable material 17 through the conduit but still allows for gas communication between the two chambers via orifice/slit 24.

When the bottle is opened by unscrewing cap 27, entrance 93 moves away from collar 94, thereby allowing the second flowable material 17 to travel upwards in the space 100 between the inner wall of standpipe 91 and outer wall of standpipe 95, by capillary action. With sufficient cap movement, protrusion 92 moves upwards and releases the seal previously applied to entrance 97 of standpipe 95, thereby allowing the second flowable material to travel upwards within space 100 above the level of entrance 97 of standpipe 95, and then downwards through the lumen of standpipe 95. This enables the second flowable material to exit from opening 96 of the standpipe into the head space 14 of the bottle. In appropriate applications of the invention, the second flowable material will then be transferred into the first flowable material 15. In yet other applications of the invention, the second flowable material may simply be transferred into the first head space of the container, and may or may not come into contact with the first flowable material.

Variations and modifications of the invention apparent to those skilled in the art are also included within the scope of this invention.

It is also to be understood that wherever used in this specification, forms of the word "comprise" are equivalent in meaning to forms of the word "include", and are not to be taken as excluding the presence of any element or feature.

What is claimed is:

1. A container for separately containing a first flowable material and a second flowable material until the mixing of the first and second flowable material is desired, comprising:

(i) a first chamber containing the first flowable material and having a first head space comprising gas at a pressure greater than or equal to atmospheric pressure;

(ii) a second chamber containing the second flowable material, the second flowable material containing gas, and the second chamber having a second head space comprising gas at a pressure greater than atmospheric pressure;

(iii) means for opening the first chamber to an environment external to that chamber, for reducing pressure in the first chamber;

(iv) means for transferring gas between the first and second chambers; and (v) means for transferring the second flowable material into the first chamber for mixing with the first flowable material, when the pressure in the first chamber is reduced, which transferring means comprises conduit means which opens at one end into said second chamber in the second flowable material below said second head space and which is configured so that on reduction of pressure in the first chamber, the conduit means conveys said second flowable material upwardly from said second chamber and then directs it downwardly into said first chamber for mixing with the first flowable material.

2. A container as claimed in claim 1, in which the means for reducing the pressure in the first chamber comprise means for opening the first chamber to the atmosphere.

3. A container as claimed in claim 2, in which the means for transferring gas between the first and the second chambers comprise means for establishing a pressure equilibrium between the first head space and the second head space.

4. A container as claimed in claim 1, in which, prior to transferring the second flowable material into the first chamber for mixing with the first flowable material, the pressure differential between the first and second head spaces is in the range 0.1 to 10 atmospheres.

5. A container as claimed in claim 1, in which the pressure in each of the first and second head spaces is between 0.1 and 10 atmospheres above atmospheric pressure.

6. A container as claimed in claim 1 in which the conduit means comprises a tube.

7. A container as claimed in claim 1, in which the second flowable material comprises one or more substances capable of:

(i) changing the colour of, or (ii) imparting a colouring to, the first flowable material, when the second flowable material is transferred into, and mixed with the first flowable material.

8. A container as claimed in claim 1, in which the second flowable material is capable of:

(i) changing the flavour, or (ii) imparting a flavour, to the first flowable material, when the second flowable material is transferred into, and mixed with the first flowable material.

9. A container as claimed in claim 1, in which:

(i) the first flowable material; or (ii) the first flowable material, in combination with the second flowable material is a beverage.

10. A container as claimed in claim 1, in which the container comprises:

(i) a bottle; or (ii) a can.

11. A container as claimed in claim 1, in which the container is a bottle, and in which the means for reducing pressure in the first chamber comprise an openable or removable structure fitted to the bottle, which, when opened or removed, exposes the first chamber to the atmosphere.

12. A container as claimed in claim 11, in which the openable or removable structure comprises a cap.

13. A container as claimed in claim 12, in which the cap is opened or removed by unscrewing it from the bottle.

14. A container as claimed in claim 11, in which the means for transferring gas between the first and second chambers comprise a path of flow communication between the first and second chambers, through which the flow of gas is initiated once the means for reducing the pressure in the first chamber are activated.

15. A container as claimed in claim 12, in which the second chamber is a structure which forms part of the cap.

16. A container according to claim 1 wherein said means for transferring gas between the first and second chambers comprises a longitudinal portion of said conduit means and an orifice for communicating said conduit means with said second chamber, whereby second flowable material conveyed along said conduit means seals the conduit means against transfer of gas from said first to said second chambers.

17. A container according to claim 16 wherein said conduit means opens at another end in said first flowable material below said first head space, and said gas transferring means includes a further orifice communicating said conduit means with said first chamber.

18. A container according to claim 17 wherein said conduit means comprises a gooseneck capillary.

19. A container according to claim 16 wherein said conduit means comprises a gooseneck capillary.

20. A container according to claim 1 wherein said conduit means comprises a gooseneck capillary.

21. A container according to claim 1 wherein said gas transferring means comprises a gas permeable wall portion between said first and second head spaces.

22. A container according to claim 1 further comprising valve means for controlling transfer of said second flowable material along said conduit means, wherein said second chamber is mounted adjacent a releasable closure for the first chamber comprising said pressure reducing means arranged whereas fastening of said closure closes said valve means.

23. A container according to claim 22 wherein said conduit means is engaged by said closure and thereby positioned to close said valve means, the conduit means moving to release said valve means on opening of said closure.

24. A container for separately containing a first flowable material and a second flowable material until the mixing of the first and second flowable material is desired, comprising:

(i) a first chamber containing the first flowable material and having a first head space comprising gas at a pressure greater than or equal to atmospheric pressure;

(ii) a second chamber containing the second flowable material, the second flowable material containing gas, and the second chamber having a second head space comprising gas at a pressure greater than atmospheric pressure;

(iii) pressure reduction means for opening the first chamber to an environment external to that chamber, for reducing pressure in the first chamber;

(iv) means for transferring gas between the first and second chambers;

(v) means for transferring the second flowable material into the first chamber for mixing with the first flowable material, when the pressure in the first chamber is reduced, which transferring means includes valve means normally closed against transfer of the second flowable material, and means connecting said pressure reduction means to said valve means and responsive to operation of the pressure reduction means to open said valve means.

25. A container according to claim 24 wherein said pressure reduction means comprises a releasable closure for the first chamber, and said connecting means is responsive to release of the closure to open said valve means.

26. A container according to claim 25 wherein said means for transferring the second flowable material comprises conduit means, and said valve means includes a communication passage between said conduit means and said second chamber.

27. A container according to claim 24 where said connecting means includes a valve member longitudinally moveable on release of said closure.

28. A container according to claim 27 wherein said valve means includes a communication passage between said first and second chambers, and wherein said valve member is a valve stem longitudinally movable from a valve closing position extending through and thereby closing said passage to a valve open position clear of said passage.

29. A container according to claim 28 where said communication passage is an orifice in a wall separating said first and second chambers.

30. A container according to claim 29 where said valve stem forms said orifice on fastening of said closure by being moved by the closure to pierce a wall of the second chamber.

31. A container according to claim 29 wherein said communication passage is a conduit.

32. A container according to claim 25 said second chamber is disposed immediately adjacent said closure for the first chamber.

33. A container according to claim 28 wherein said second chamber is disposed immediately adjacent said closure for the first chamber.

34. A container according to claim 30 wherein said second chamber is disposed immediately adjacent said closure for the first chamber.

35. A container as claimed in claim 24 in which the means for transferring gas between the first and second chambers comprises means for establishing a pressure equilibrium between the first head space and the second head space.

36. A container as claimed in claim 24, in which, prior to transferring the second flowable material into the first chamber for mixing with the first flowable material, the pressure differential between the first and second head spaces is in the range 0.1 to 10 atmospheres.

37. A container as claimed in claim 24 in which the pressure in each of the first and second head spaces is between 0.1 and 10 atmospheres above atmospheric pressure.

38. A container as claimed in claim 24, in which the container comprises:

(a) a bottle; or (b) a can.

39. A container according to claim 25 wherein the container is a bottle and said releasable closure is a cap for the bottle.

40. A container as claimed in claim 39, in which the cap is opened or removed by unscrewing it from the bottle.

41. A container as claimed in claim 39, in which the second chamber is a structure which forms part of the cap.

42. A container as claimed in claim 24, in which the second flowable material comprises one or more substances capable of:

(i) changing the colour of, or (ii) imparting a colouring to, the first flowable material, when the second flowable material is transferred into, and mixed with the first flowable material.

43. A container as claimed in claim 24 in which the second flowable material is capable of:

(i) changing the flavour, or (ii) imparting a flavour, to the first flowable material, when the second flowable material is transferred into, and mixed with the first flowable material.

44. A container as claimed in claim 24, in which:

(a) the first flowable material; or (b) the first flowable material, in combination with the second flowable material is a beverage.

45. A container for separately containing a first flowable material and a second flowable material until the mixing of the first and second flowable materials is desired, comprising:

(i) a first chamber containing the first flowable material and having a first head space comprising gas at a pressure greater than or equal to atmospheric pressure;

(ii) a second chamber containing the second flowable material, the second flowable material containing gas, and the second chamber having a second head space comprising gas at a pressure greater than atmospheric pressure;

(iii) means for opening the first chamber to an environment external to that chamber, for reducing pressure in the first chamber;

(iv) means for transferring the second flowable material into the first chamber for mixing with the first flowable material, when the pressure in the first chamber is reduced, which transferring means comprises conduit means extending upwardly from a lower opening into the second flowable material below the second head space, to an upper opening in said first flowable material, which conduit means contains an airlock releasable on said reduction of pressure in the first chamber to allow transfer of the second flowable material along the conduit means to mix with the first flowable material.

46. A container according to claim 45 further including a flap to prevent flow of the first flowable material into the second chamber arising from a temperature induced pressure increase in the first head space.

47. A container according to claim 45 wherein said conduit means is a tube or capillary.

48. A container as claimed in claim 45, in which the second flowable material comprises one or more substances capable of:

(i) changing the colour of, or (ii) imparting a colouring to, the first flowable material, when the second flowable material is transferred into, and mixed with the first flowable material.

49. A container as claimed in claim 45, in which the second flowable material is capable of:

(i) changing the flavour, or (ii) imparting a flavour to, the first flowable material, when the second flowable material is transferred into, a mixed with the first flowable material.

50. A container as claimed in claim 45 in which:

(a) the first flowable material; or (b) the first flowable material, in combination with the second flowable material is a beverage.

51. A container as claimed in claim 45, in which the container comprises:

(a) a bottle; or (b) a can.

* * * * *